US010087677B2

(12) United States Patent
Sosa et al.

(10) Patent No.: US 10,087,677 B2
(45) Date of Patent: Oct. 2, 2018

(54) GREEN WINDOW SYSTEM

(71) Applicant: GREEN STAR ENERGY LLC, Guaynabo, PR (US)

(72) Inventors: Ricardo A. Sosa, Guaynabo, PR (US); Kevin Nieves-Garcia, Guaynabo, PR (US); Carlos Goyco-Graziani, Guanica, PR (US)

( * ) Notice: Subject to any disclaimer, the term of this patent is extended or adjusted under 35 U.S.C. 154(b) by 0 days.

(21) Appl. No.: 14/990,154

(22) Filed: Jan. 7, 2016

(65) Prior Publication Data

US 2016/0115730 A1 Apr. 28, 2016

Related U.S. Application Data

(63) Continuation-in-part of application No. 14/577,637, filed on Dec. 19, 2014, now abandoned.

(Continued)

(51) Int. Cl.

| | |
|---|---|
| ***E06B 9/01*** | (2006.01) |
| ***E06B 7/086*** | (2006.01) |
| ***E05F 11/10*** | (2006.01) |
| ***E06B 3/08*** | (2006.01) |
| ***E06B 3/263*** | (2006.01) |
| ***E06B 3/67*** | (2006.01) |
| ***E06B 5/20*** | (2006.01) |

(Continued)

(52) U.S. Cl.

CPC ..... *E06B 7/086* (2013.01); *E05F 11/10* (2013.01); *E06B 3/08* (2013.01); *E06B 3/263* (2013.01); *E06B 3/6707* (2013.01); *E06B 5/205* (2013.01); *E06B 7/098* (2013.01); *E05Y 2800/353* (2013.01); *E05Y 2800/40* (2013.01); *E05Y 2900/10* (2013.01); *E06B 3/66328* (2013.01); *E06B 5/11* (2013.01); *E06B 5/12* (2013.01)

(58) Field of Classification Search

CPC . E06B 7/10; E06B 7/084; E06B 7/086; E06B 5/10; E06B 3/24

USPC ..... 49/89.1, 92.1; 52/786.13

See application file for complete search history.

(56) References Cited

U.S. PATENT DOCUMENTS 3,287,852 A * 11/1966 Belden ..... E06B 7/084 454/278

4,855,716 A * 8/1989 Jordal ..... E06B 7/086 340/541

(Continued)

*Primary Examiner* — Katherine W Mitchell
*Assistant Examiner* — Abe Massad
(74) *Attorney, Agent, or Firm* — Eugenio J. Torres-Oyola; Victor M. Rodriguez-Muriel; Rafael Rodriguez-Muriel

(57) ABSTRACT

The system is compose of a series of operable louvers mounted on a four sided frame and connected on each side to the operating mechanism that allows for easy opening and closing of the louvers. Every part of the system that is exposing to the exterior of the building is separated from the interior part of the system by a low heat conductivity material as a thermal barrier. Each operable louver is composing of a four sided main frame, two panes of glass (inner and outer) and a coupling mechanism on each side that connects to the operating mechanism. The main frame acts as the thermal break as well as a system that absorbs the energy created when an outside object impacts the window from the outside. The system incorporates sealing devices between all moving parts to eliminate water and air infiltration. The operating system allows for easy opening and closing of the window by rotating each louver with the crank mechanism assisted by springs.

11 Claims, 25 Drawing Sheets

Related U.S. Application Data

(60) Provisional application No. 61/917,955, filed on Dec. 19, 2013.

(51) Int. Cl.

| | |
|---|---|
| ***E06B 7/098*** | (2006.01) |
| *E06B 3/663* | (2006.01) |
| *E06B 5/11* | (2006.01) |
| *E06B 5/12* | (2006.01) |

(56) References Cited

U.S. PATENT DOCUMENTS

| | | | | | |
|---|---|---|---|---|---|
| 4,889,040 | A * | 12/1989 | Man | E06B 7/086 | 454/224 |
| 6,098,339 | A * | 8/2000 | Rivera | E06B 7/086 | 49/73.1 |
| 6,363,660 | B1 * | 4/2002 | Saelzer | E06B 5/106 | 49/401 |
| 6,401,428 | B1 * | 6/2002 | Glover | E06B 3/24 | 52/786.1 |
| 8,156,688 | B2 * | 4/2012 | Tan | E06B 7/084 | 49/403 |

* cited by examiner

GREEN WINDOW SYSTEM

STATEMENT REGARDING FEDERALLY SPONSORED RESEARCH AND DEVELOPMENT

N/A

RELATED APPLICATIONS

This application claims the benefit of U.S. Non-provisional application Ser. No. 14/577,637 filed Dec. 19, 2014, which is hereby incorporated by reference in its entirety.

BACKGROUND OF THE DISCLOSURE

Field of the Invention

The present invention relates to a system and method for improved louver windows, and specifically to improved manufacture and efficiency processes of said assemblies.

Description of the Related Art

In response to the high levels of crime, economic, environment and energy crises, there is a clear need to create products that address them. It is imperative to address public, schools, universities, hospitals, shopping malls and other safety against terrorist attack by internal and external means. The above must be done while taking into account how indiscriminate residential and product entrapment installation of railings may obstruct emergency exits during events such as floods or fire. The challenge is product development capable of protecting human beings and injecting into the economy new jobs while improving our quality of life.

One such area for product development is dwelling windows. These require a window product that has stylized appearance combined with a conservative classic elegant look that blends into the landscape providing a sense of freedom, but at the same time incorporates the essential safety feature against theft, vandalism, tornadoes, hurricanes, sound, and other issues while placing energy disadvantages at the forefront of their beneficiaries.

SUMMARY OF THE INVENTION

The present invention relates to an operable louver window system that can protect a building from vandals (forceful entry), tornadoes, and hurricanes and meet the Energy Star requirements for all 4 zones of mainland USA. The uniqueness of this new product is that it can protect the building from vandals in the close as well as in the open position. In the close position the window will meet the thermal efficiencies required by the Energy Star certifications and the impact test requirements of the Unified Building Code 2012 (UBC). In the open position it will allow for natural ventilation of the enclosed building and still protect the same against forceful entry.

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

In one aspect the invention is about an apparatus comprising one or more monobloc glass louvers, one or more chromoly bars, and an integrated operator shifter comprised of a compact assembly. In more detail, the invention is about a window frame having upper, lower, left and right walls, a plurality of chromoly bars for increased security, a plurality of louvers extending from the left wall to the right wall of the window frame, the plurality of louvers being rotatable about a parallel axis, a drive coupling extending from at least one side of each of the plurality of louvers so as to allow synchronous rotation of the plurality of louvers about the parallel axis, an operating bar within at least one the left wall or right wall of the window frame, the operating bar being connected with the drive coupling in each of the plurality of louvers and, an operator shifter comprising a window opening assisting mechanism coupled to the operating bar, said assisting mechanism providing an angular displacement with respect to the operating bar, a distant holder coupled to the operating bar, a biasing device having an upper and a lower side, the upper and lower side of the biasing device operatively coupled to the assisting mechanism and the distant holder, respectively, and, a handle bar operatively coupled to the operating bar.

Other features and advantages of the present invention will become apparent upon examining the following detailed description of an embodiment thereof, taken in conjunction with the attached drawings.

Figure 1A:
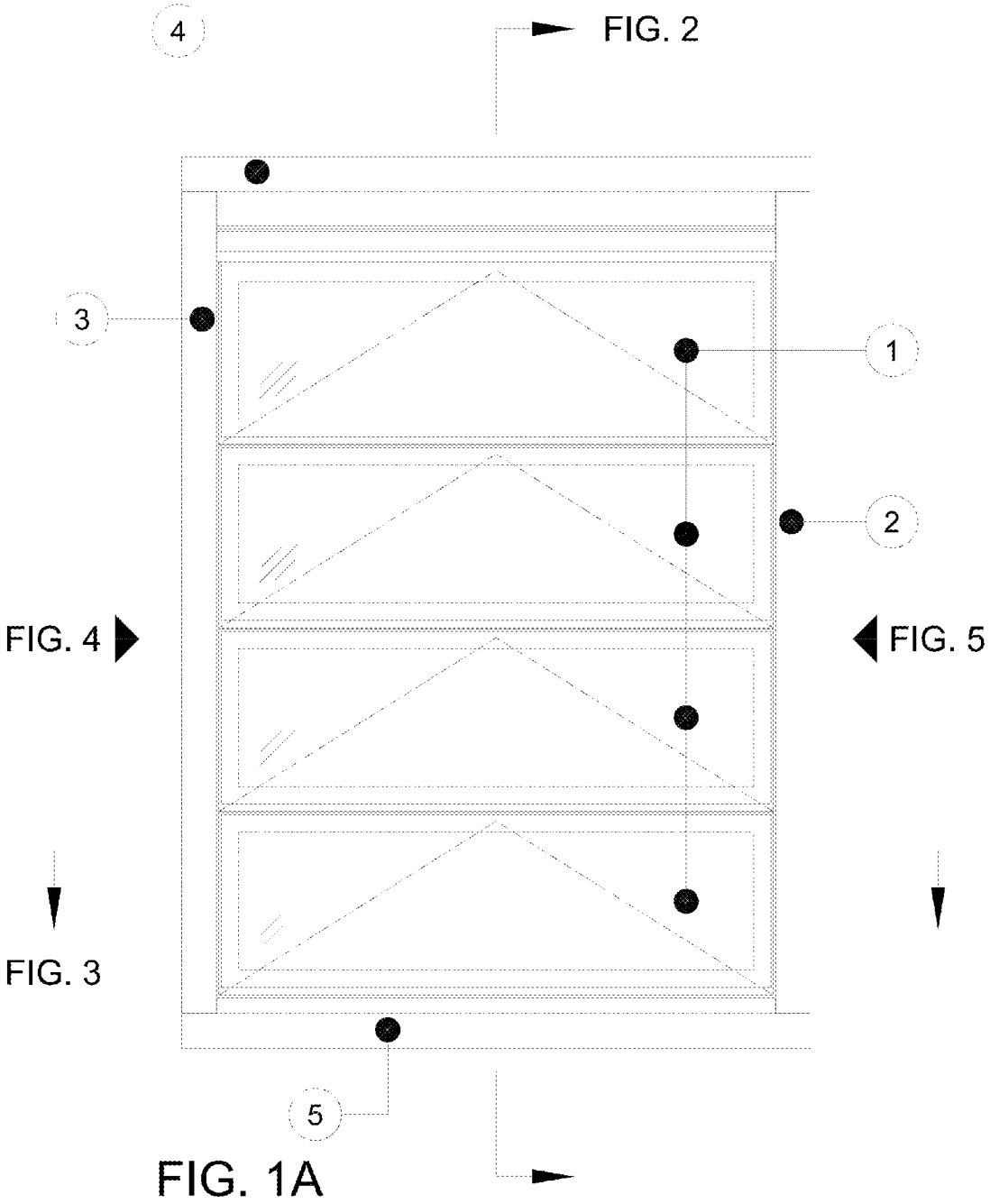
FIG. 1A-1B are exemplary views of the structure of the first preferred embodiment in accordance with the principles of the present invention.

The above-described and other features will be appreciated and understood by those skilled in the art from the following detailed description, drawings, and appended claims.

DETAILED DESCRIPTION OF THE PREFERRED EMBODIMENT

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

Figure 1B:
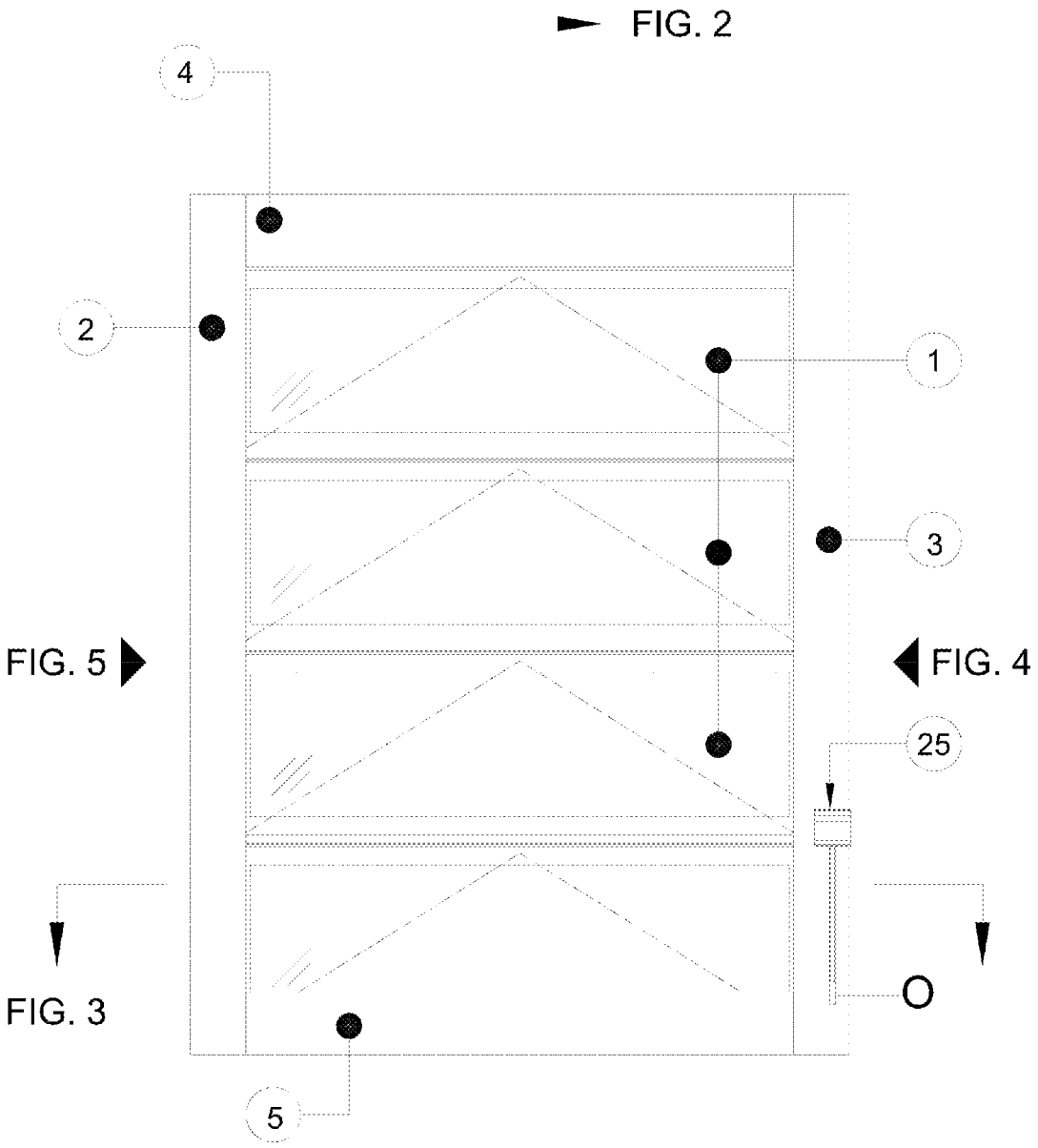

FIG. 1A is directed to a front exemplary view of the structure of the first preferred embodiment in accordance with the principles of the present invention. The front view represents the portion of the window that is exposed to the outdoor. FIG. 1B is directed to a back exemplary view of the structure of the first preferred embodiment in accordance with the principles of the present invention The back view represent the portion of the window that is located inside the building structure. The first embodiment comprises a housing, wherein said housing comprises a top fame part 4, a first side frame part 3, a second side frame part 2 and a bottom frame part 5. Further the first embodiment comprises at least a louver 1 and operator system (described in details below). The louver 1 is mechanically coupled to the operator system in order to rearrange and/or provide angular displace of the louver. The term mechanically coupled is intended to include the attachment of two or more elements using a third element, such as rivet, to at least maintain a constant connection between said two or more elements. In this context, the term "mechanically coupled" is used to mean coupled together so as to be able to transmit rotation or displacement of an element, such as is the case when elements are connected to a travel bar by rivets. As mentioned above, an object of the present disclosure is to provide a compact, efficient and convenient system that reduces the effort, time in operation and being virtually unbreakable. The operator system is configured to provide a system that reduces effort and operation time. The operator system operates without a complex mechanical connection between parts, which allows the system to take advantage of natural leverage point mechanism reducing the force required for operation without increasing the length of the lever. In an alternate embodiment, the equipment may have simultaneous optional manual or automatic operation. As shown in FIG. 1, FIG. 2 through FIG. 5 are exploded views of the marked sections per figure. The purpose is to provide a more detailed view of each part and respective elements.

Figure 2:
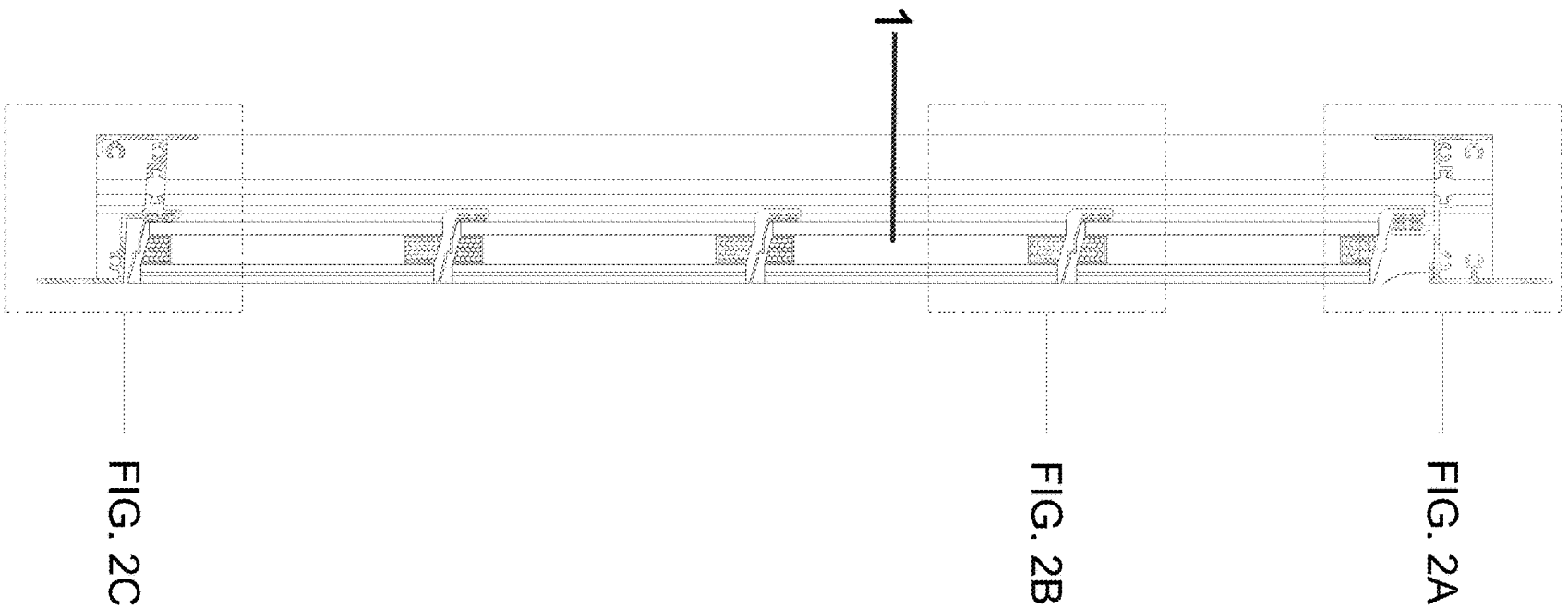
FIG. 2 is a vertical cut-out section of FIG. 1 of the structure of the first preferred embodiment in accordance with the principles of the present invention.

FIG. 2 is directed to the first embodiment side view, more particularly to part of the second side frame. FIG. 2 is further divide into FIG. 2A, FIG. 2B and FIG. 2C for purpose of a better understanding of the present disclosure. FIG. 2 provides a top second side frame view as disclosed by FIG. 2A, middle second side frame view as disclosed by FIG. 2B, and bottom second side frame view as disclosed in FIG. 2C.

Figure 2A:
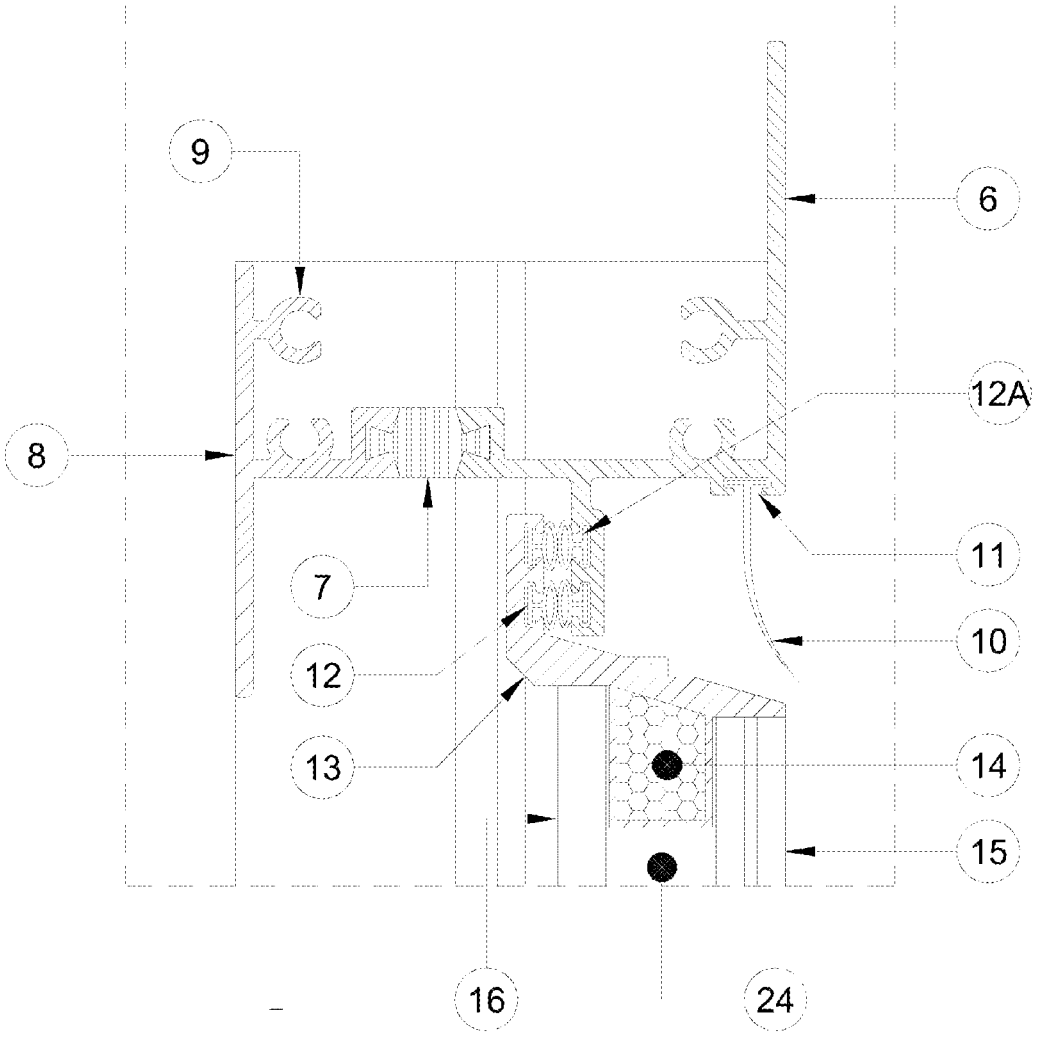
FIG. 2A-2C are exemplary exploded view of the cut-out section of FIG. 1 of the structure of the first preferred embodiment in accordance with the principles of the present invention

The top second side frame 4, as shown in FIG. 2A, comprises an outer frame 6, heat transfer barrier 7, inner frame 8, attachment receivers 9, environmental barrier 10, environmental barrier receiver 11 and seal 12*a*. The heat barrier 7 is mechanically coupled between the outer frame and inner frame to avoid heat transfer between said parts. The outer frame and inner frame comprises attachment receivers 9. The attachment receiver assists to attach properly the top frame part 4 with the second side frame part. The outer frame further comprises a protrusion that holds at least a seal 12*a*. The seal in preferably made of rubber material that is flexible and withstand weather changes (i.e. cold weather and hot weather). As shown the louver 1 is in contact with the outer frame 6 by means of a sealer 12 which is couple to the top louver frame 13. The louver 1 comprises a honey comb structure integrally made with the top louver frame 13. The louver 1 also includes a first face 15, a middle section 24 and a back face 16 which are explained in details below.

Figure 2B:
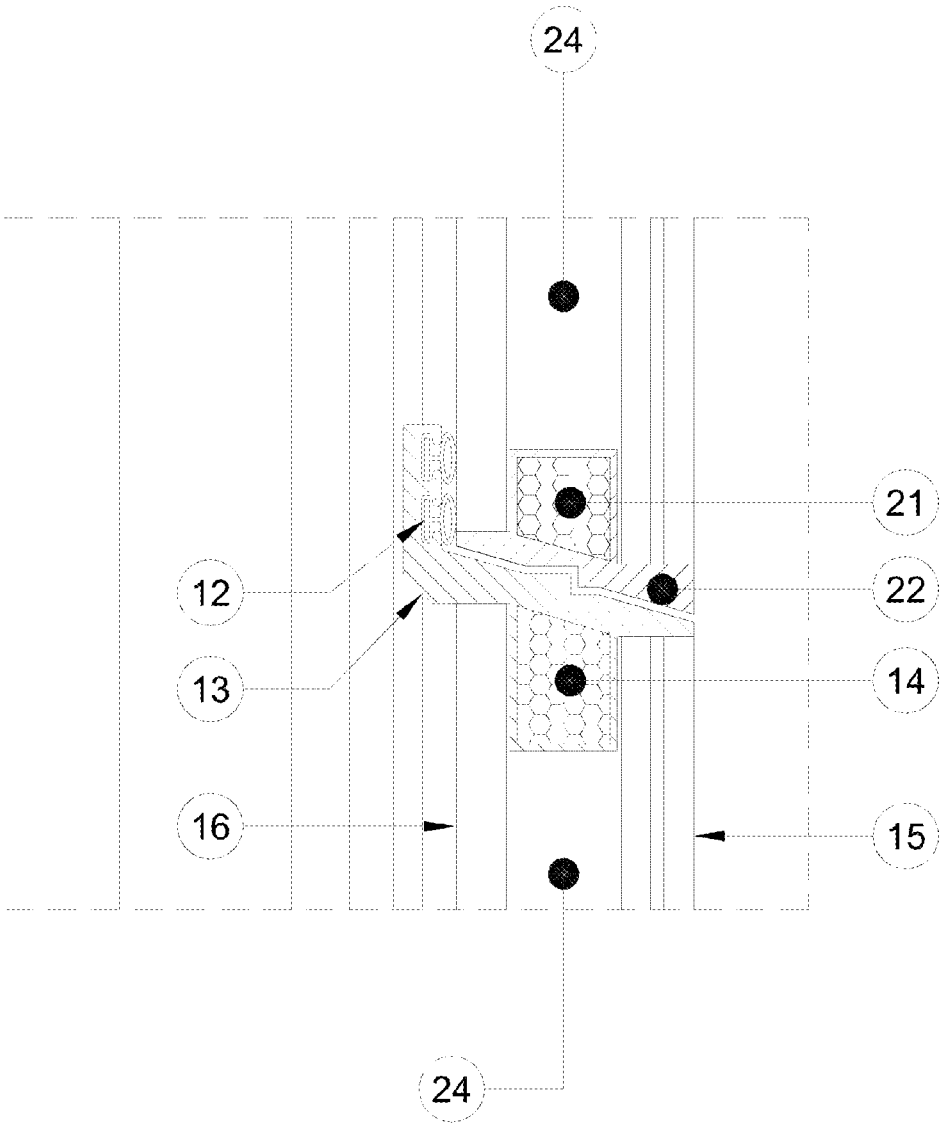

FIG. 2B is directed to middle second side frame view. It is important to understand that several louvers 1 may be employed with the system. Therefore when more than one louver 1 is used a mechanism is provided to seal the connection between louvers 1. For example, as shown in FIG. 2B, a seal 12 is provided with the top louver frame 13 to seal the connection between louvers 1. Further the top louver frame 13 and bottom louver frame 22 are shaped to match in such way that when an adjacent louver rotates to a vertical position, with respect to the bottom frame part 5, the seal attach to the top louver frame 13 end in close contact with the back face 16.

Figure 2C:
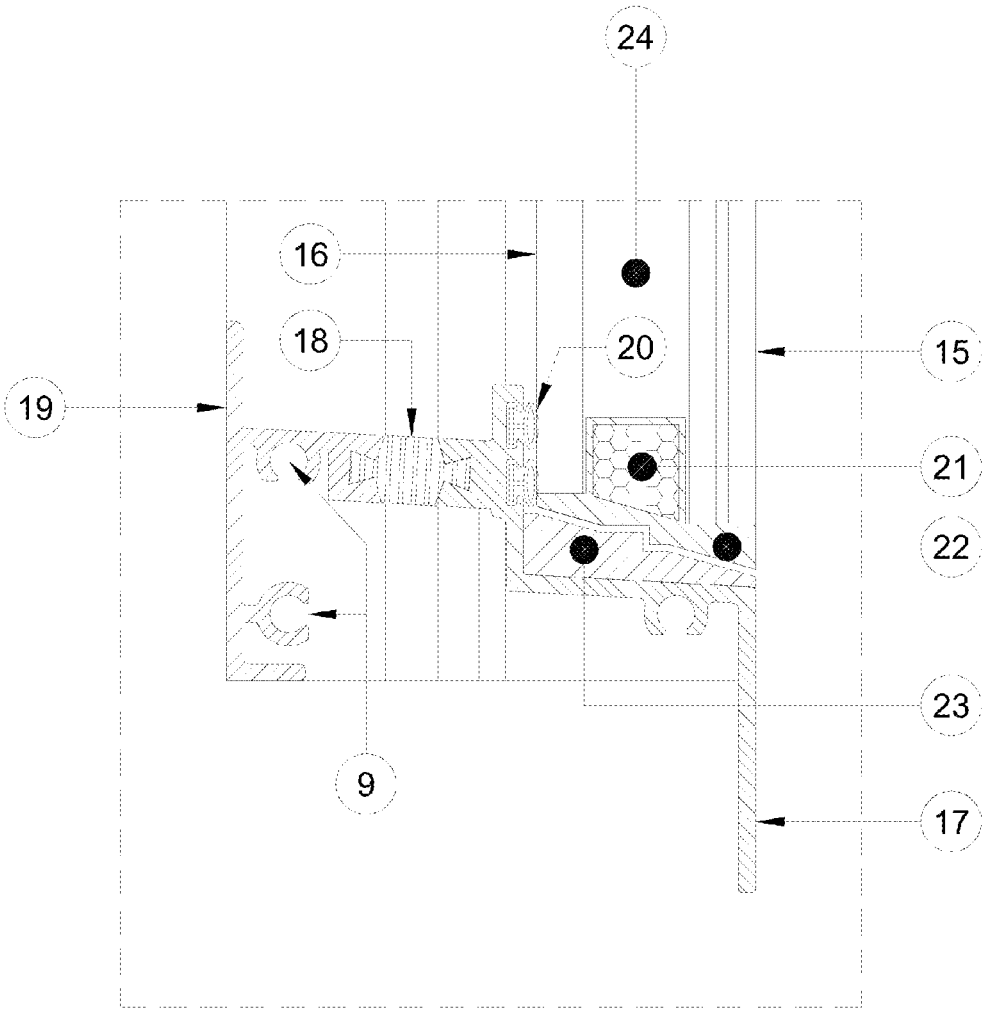

FIG. 2C is directed to the bottom second side frame view, which is approximately similar in function to FIG. 2A, comprising comprises an outer frame 17, heat transfer barrier 18, inner frame 19, attachment receivers 9 and seal 20. The heat barrier 18 is attached between the outer frame 17 and inner frame 19 to avoid heat transfer between said parts. The outer frame and inner frame comprises attachment receivers 9. A seal 20 is coupled to the outer frame 17. Further the outer frame 17 comprises a second seal. The second seal is made of the same material as the bottom louver frame 22. The second seal is configured to receive and match the shape of said bottom louver frame 22.

Figure 3:
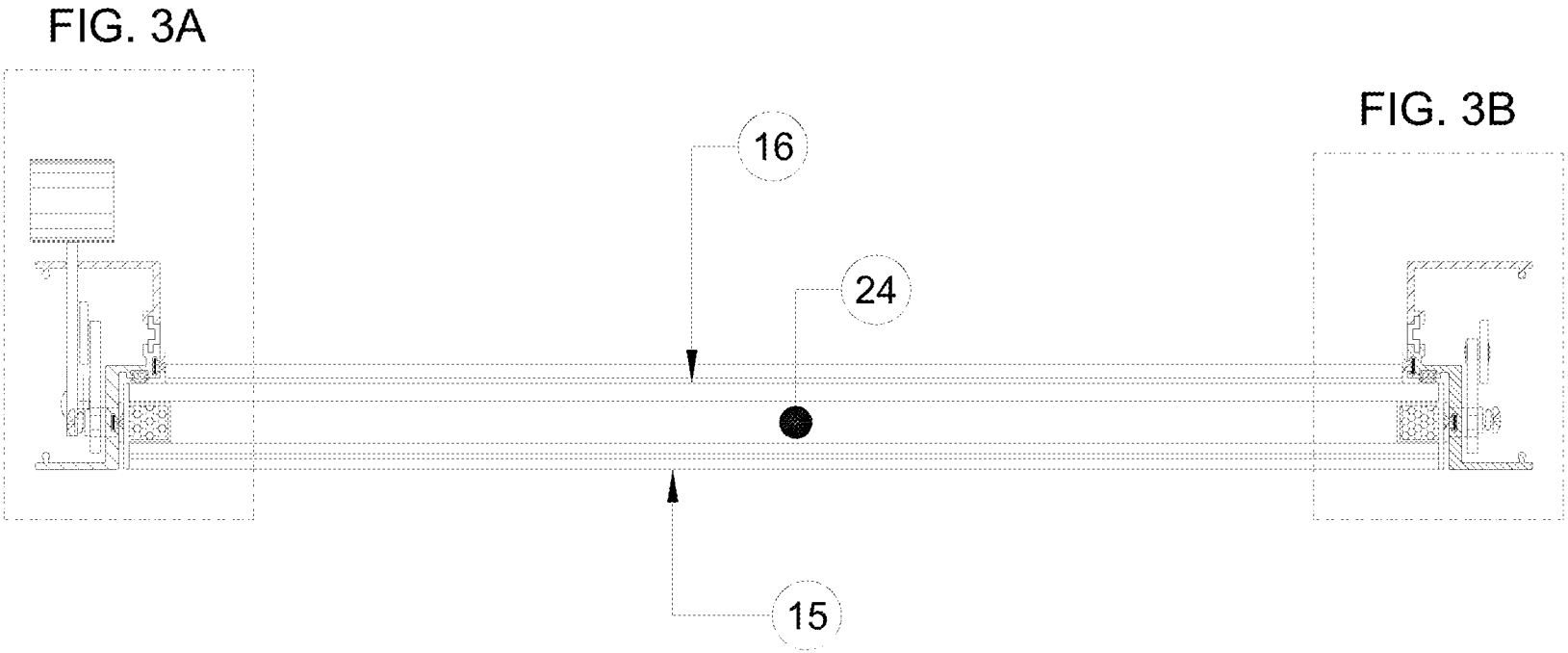
FIG. 3 is a horizontal cut-out section of FIG. 1 of the structure of the first preferred embodiment in accordance with the principles of the present invention.
Figure 3A:
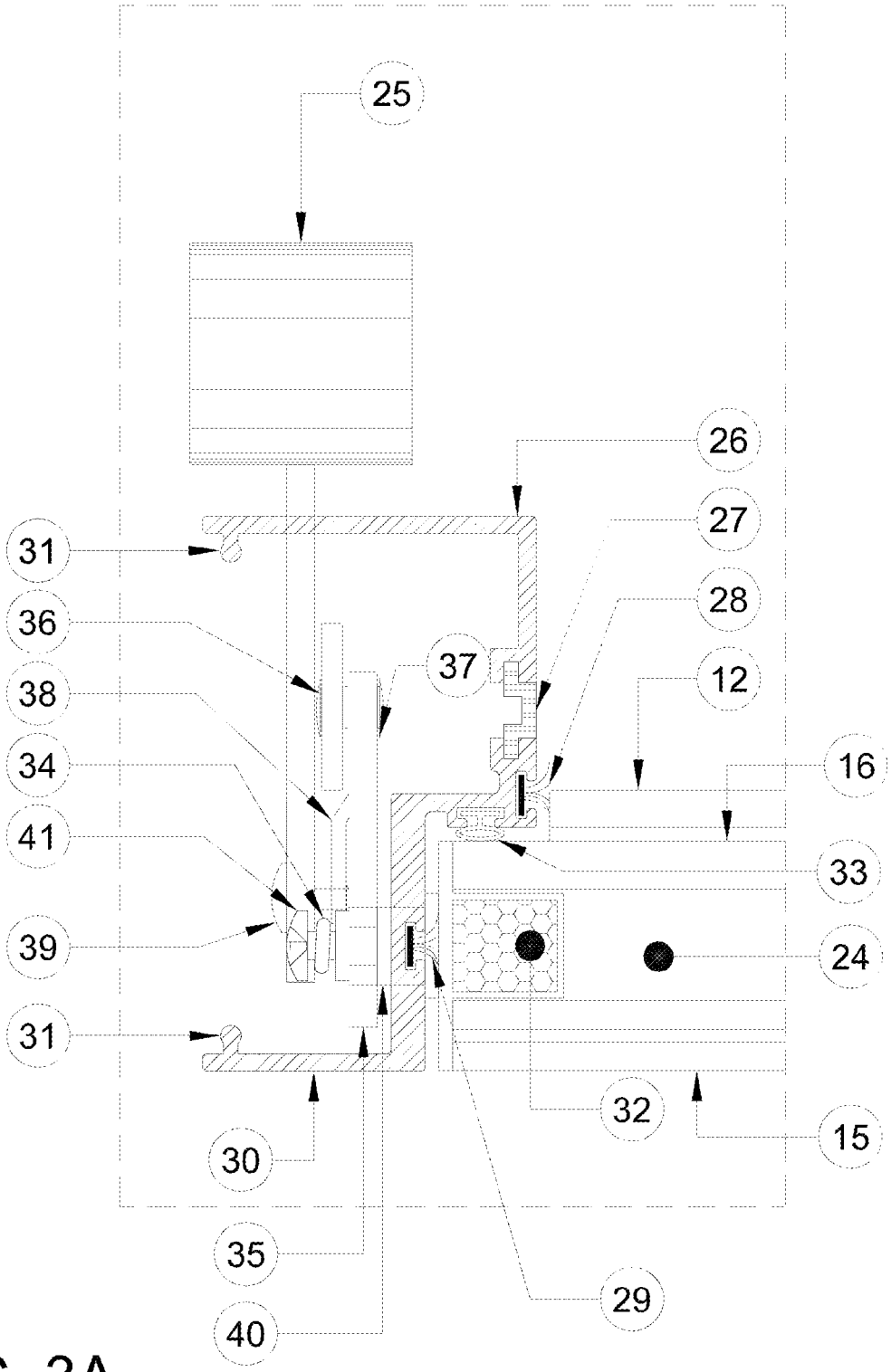
FIG. 3A-3B are exemplary exploded view of the cut-out section of FIG. 1 of the structure of the first preferred embodiment in accordance with the principles of the present invention
Figure 3B:
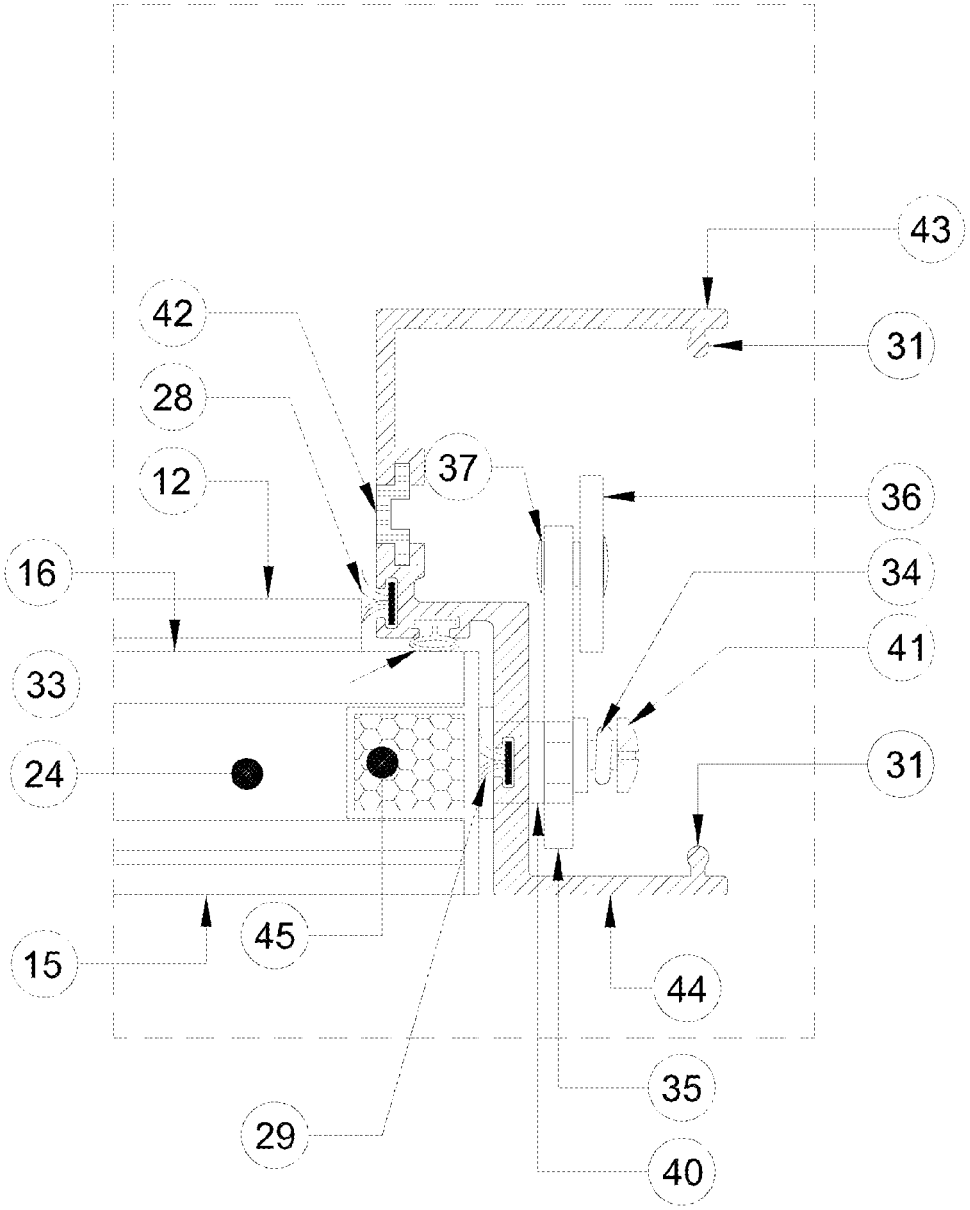

FIG. 3 is directed to the operator system coupled to the louver 1. As shown, in FIG. 3A, the operator system comprises a shifter 25 and several elements (explained below) coupled to the louver 1, more particularly the louver side frame 2,3. The inner frame 26 is coupled to outer frame 30 by a heat transfer barrier 27. The outer frame comprises an outer hole, an inner environmental barrier 28, outer environmental barrier 29 and first vertical sealer 33. The inner environmental barrier 28 serves as a barrier for dust and other element while the outer environmental barrier 29 provides the same protection from the outside dust. The inner frame 26 and outer frame 30 comprises a frame attachment 31. The frame attachment 31 extends vertically and it is used to attach more than one housing of the present disclosure. The louver 1, as shown, is hold between the side frames 2, 3. The louver attachment 57, disclosed below, passes through the outer frame hole and is supported by the crank 35. The bearing portion 54 of the louver attachment 57 is in contact with the outer hole surface, in such way that hold the louver on a particular vertical position with respect to the bottom part 5; and simultaneously allows the rotational displacement of the louver 1. Similar, as shown in FIG. 3B, the louver 1 is coupled to the inner frame 43 by the operator system, which is explained below. The inner frame 43 is coupled to outer frame 44 by a heat transfer barrier 42. The outer frame 44 comprises an inner environmental barrier 28, outer environmental barrier 29 and another first vertical sealer 33. The first vertical sealer extends vertically on said second frame part 2 and first side frame part 3.

Figures 4, 4A, 4B, 4C:
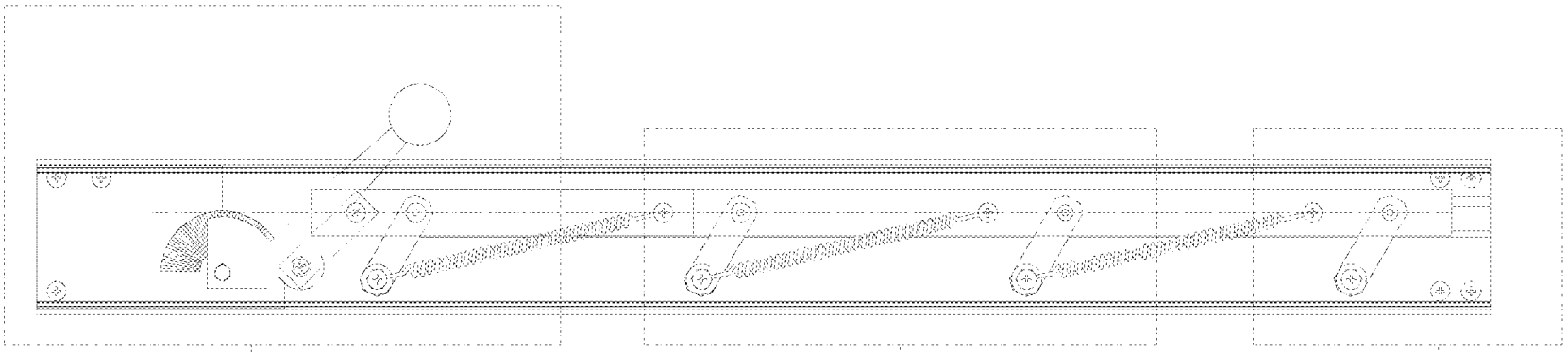
FIG. 4 is an exemplary view of the opening mechanism with actuator on a first lateral side of the first preferred embodiment in accordance with the principles of the present invention.
FIG. 4A-4C are exemplary exploded view of the opening mechanism on a first lateral side of the first preferred embodiment in accordance with the principles of the present invention.
Figure 4A:
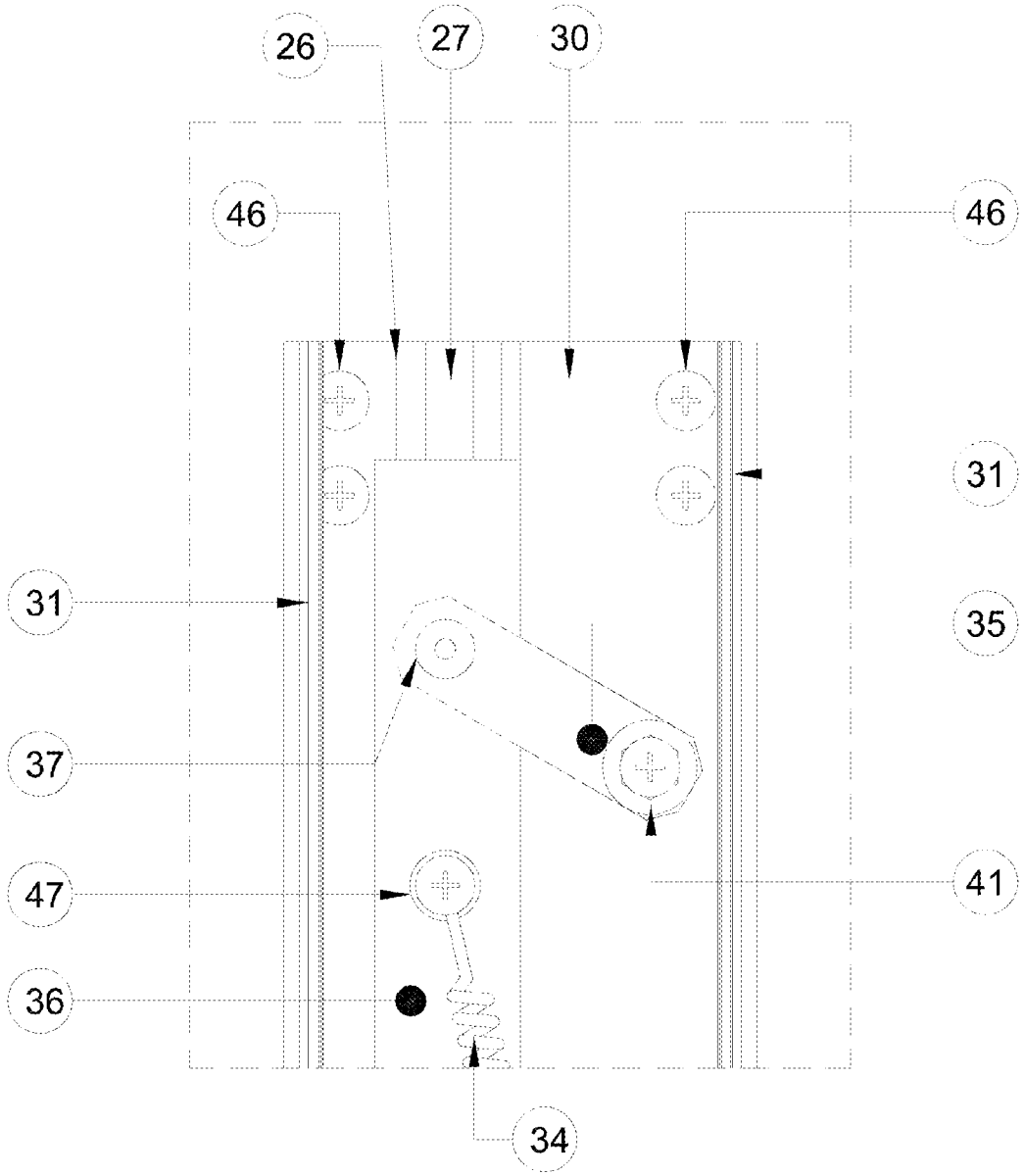
Figure 4B:
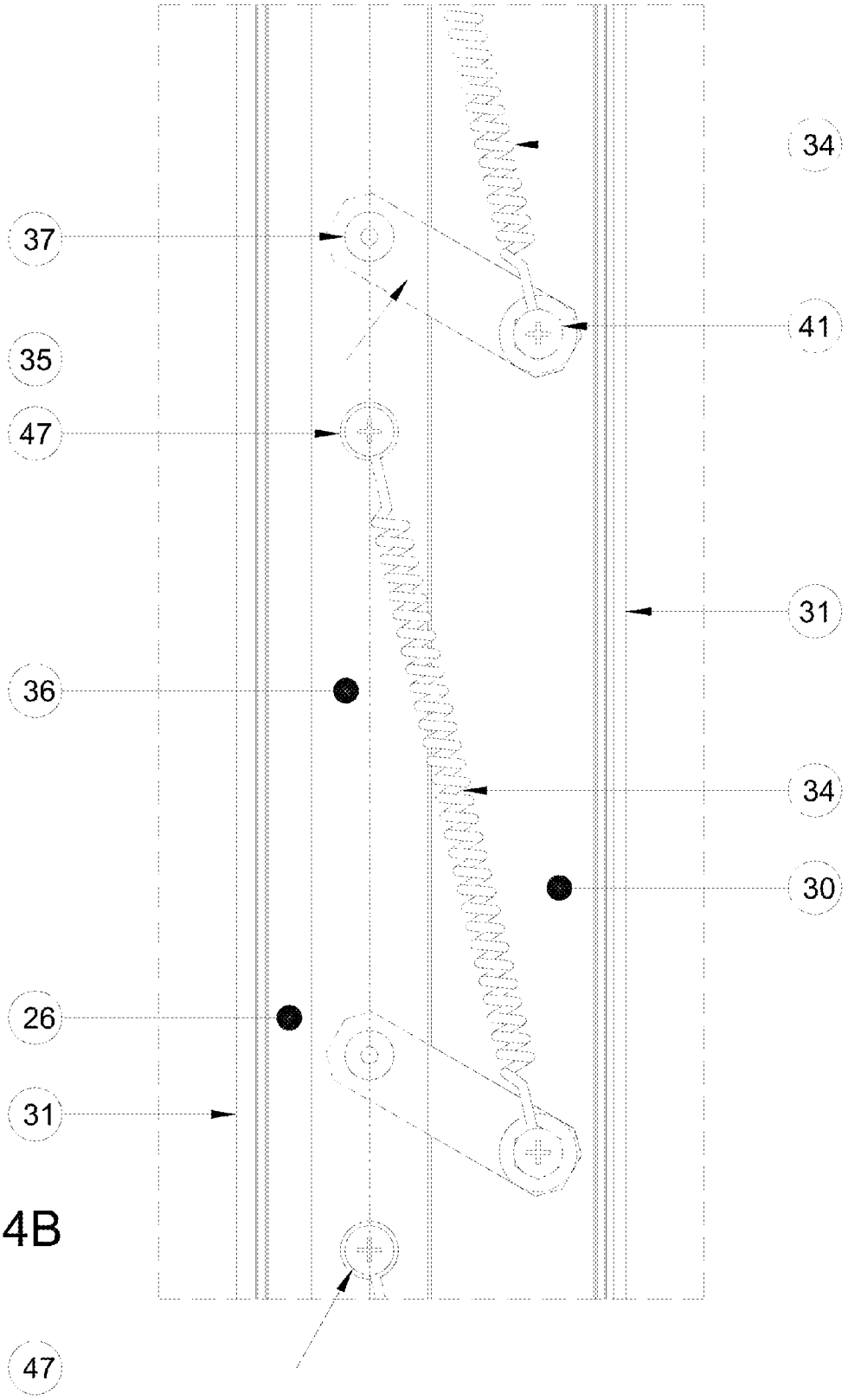
Figure 4C:
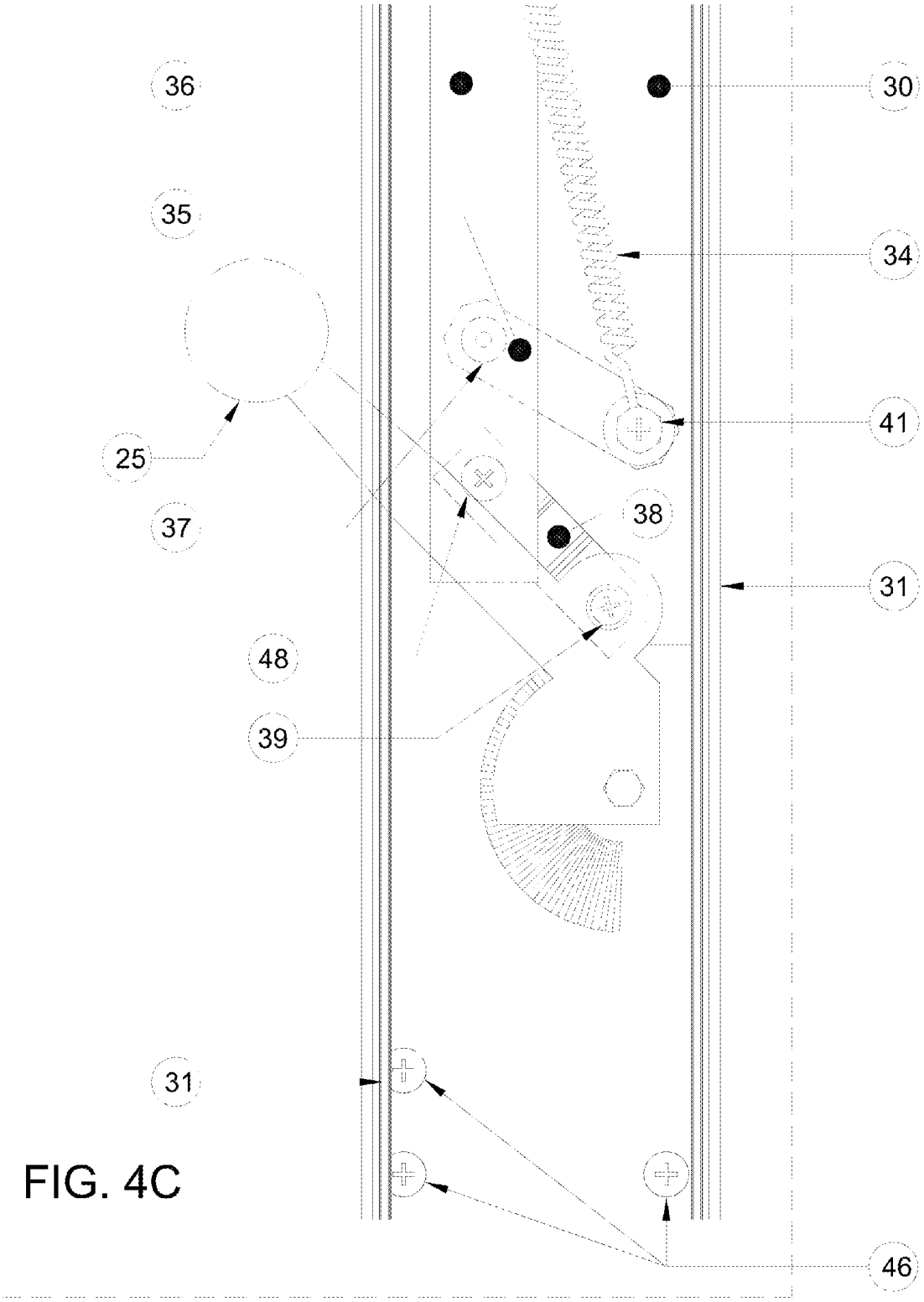

Mainly the operator system, which manages the displacement of the louvers 1, is located inside the first side frame part 3 and second side frame part 2. FIG. 4 is directed to the operator system located at the first side frame part 3, more particularly the side with the actuator or shifter 25, wherein said FIG. 4 is divided into at least three exploded views, as shown in FIG. 4A, FIG. 4B and FIG. 4C, for a better understanding of the operator system. The top part of the operator system, as shown in FIG. 4A, comprises a travel bar 36, a crank 35 and at least an elastic member 34. The elastic member, such as spring, comprises at least two ends wherein at least one of those ends is mechanically coupled to the travel bar 36 and a second end is coupled to the louver 1, more particularly the louver attachment 57. The crank 35 further comprises two ends, wherein one end is mechanically coupled to the travel bar 36 and the other end is attached to the louver attaching element 57 by means of attachment element 41, such as screw. FIG. 4B is directed to the middle section of the operator system. As shown the second end of the crank 35 is coupled to the elastic member 34 and the louver attachment 57. FIG. 4C is directed to the bottom part of the operator system. The operator system comprises a shifter 25. The shifter extends inside the housing as is coupled to the travel bar 36 by means of a transmitter bar 38. Any action or force applied to the shifter is transferred to the travel bar by means of the transmitter bar 38. The transmitter bar 38, which made of a solid structure capable of retain its body length without deformation, comprises at least one end coupled to the shifter by an attaching element 39 and a second end coupled to the travel bar 36 by another attaching element 48. The shifter comprises a traveling path which assists the rotational displacement of the shifter 25. The traveling path serves as a ratchet mechanism to hold the shifter in a particular position of the radial body of the travel path. The first frame part 3 comprises an opening O providing enough space for the linear displacement, with respects to the first frame part 3, of the shifter 25. The opening O maybe covered with a material to avoid dust to get inside the first frame part 3. Further on the top part and bottom part of the side frame comprises several attaching elements 46 used to fix the second side frame part 2 to the bottom frame part 5 and top frame part 4. The attaching elements 46 are coupled to the attachment receiving ends 9.

Figure 5:
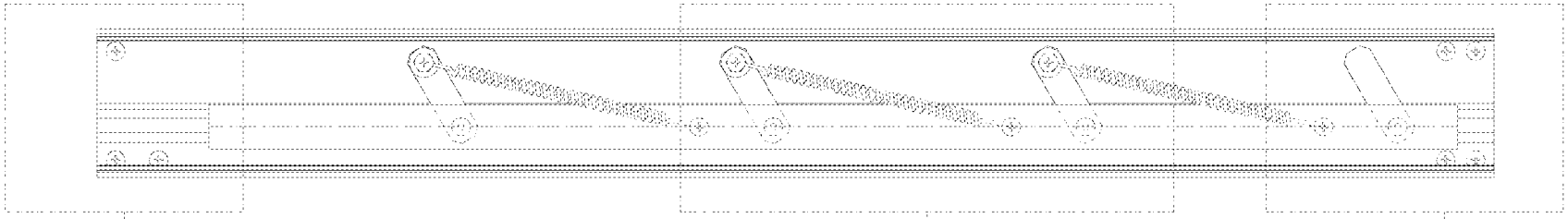
FIG. 5 is an exemplary view of the opening mechanism with actuator on a second lateral side of the first preferred embodiment in accordance with the principles of the present invention.
Figure 5A:
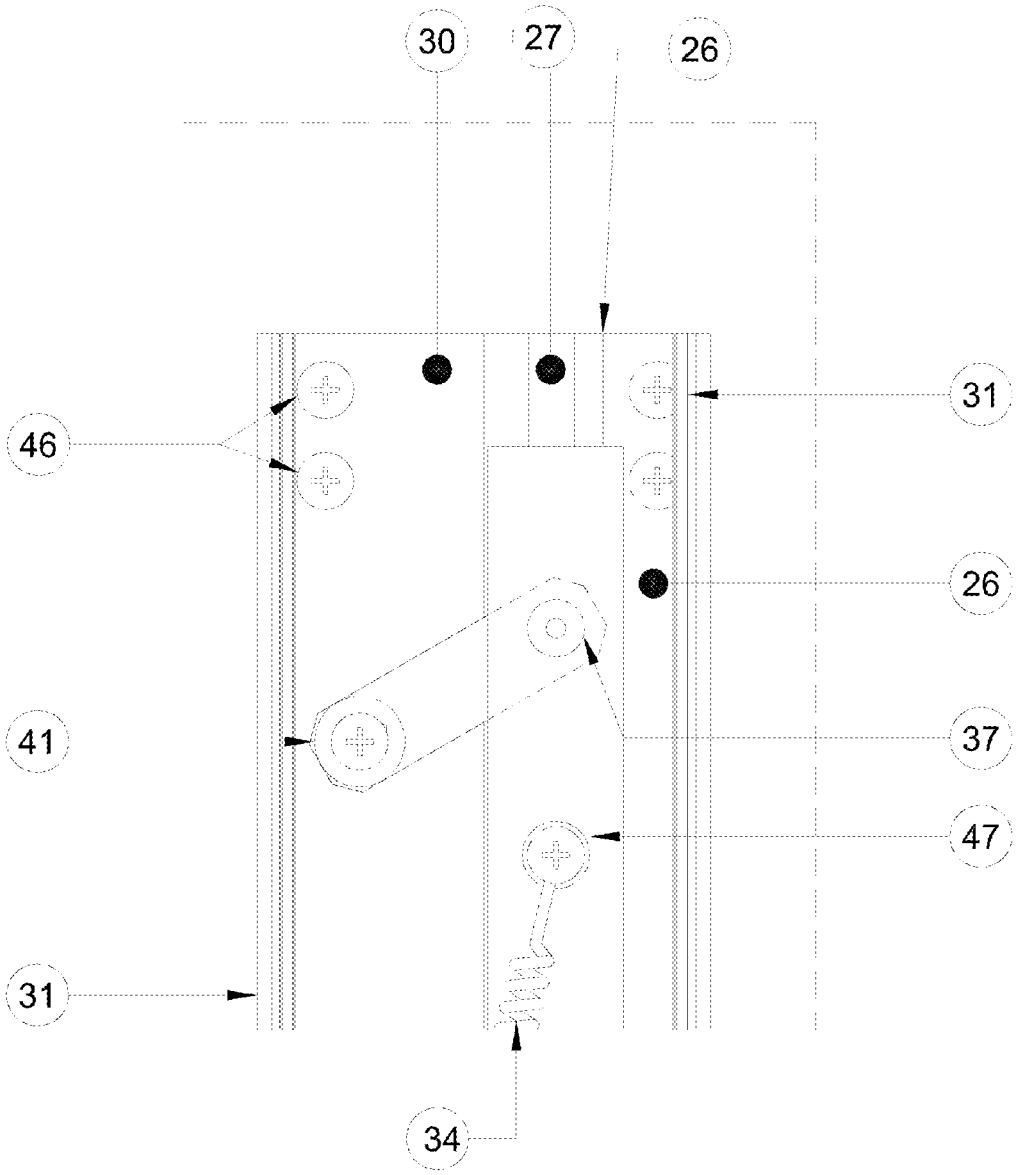
FIG. 5A-5C are exemplary exploded view of the opening mechanism on a first lateral side of the first preferred embodiment in accordance with the principles of the present invention.
Figure 5B:
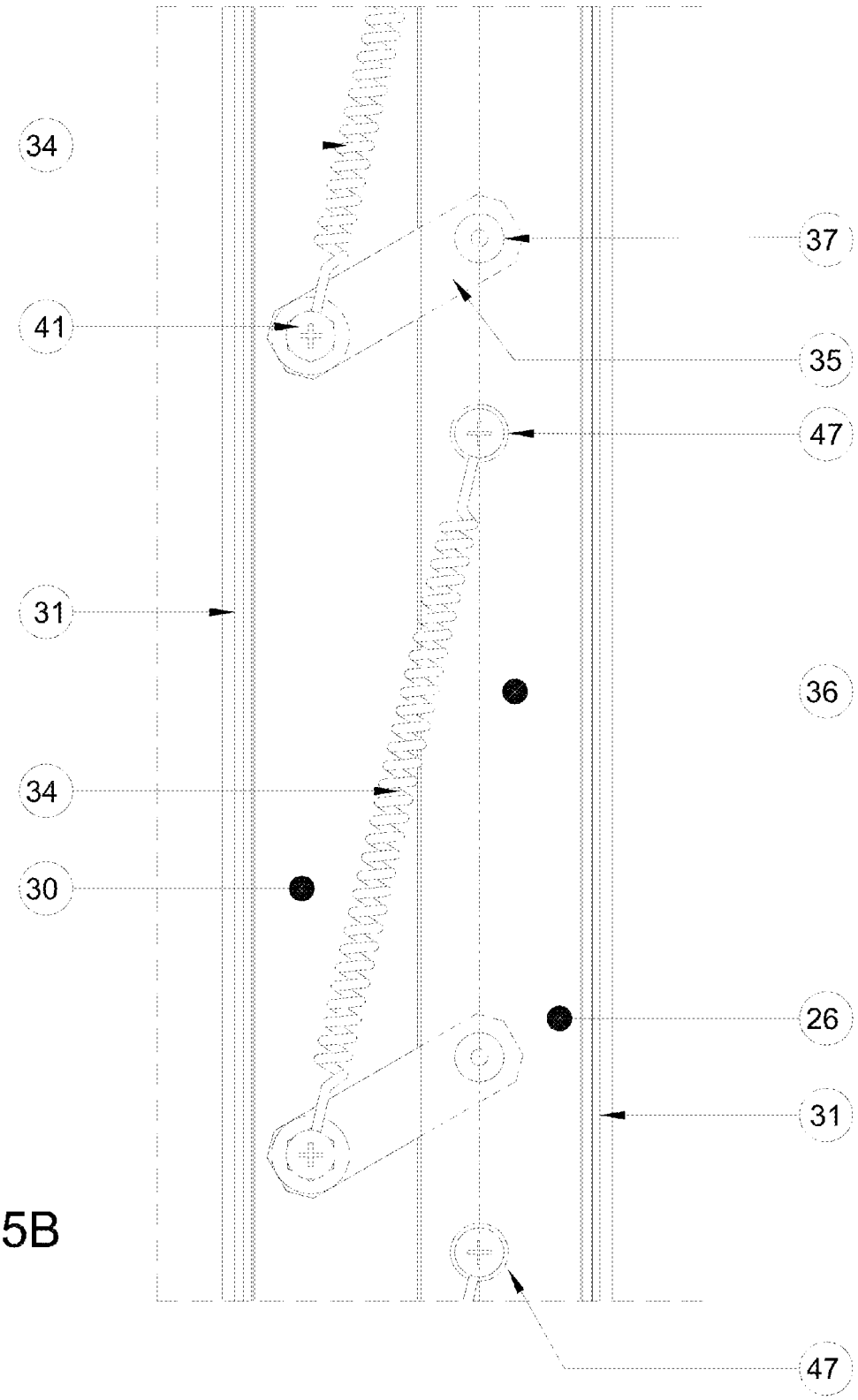
Figure 5C:
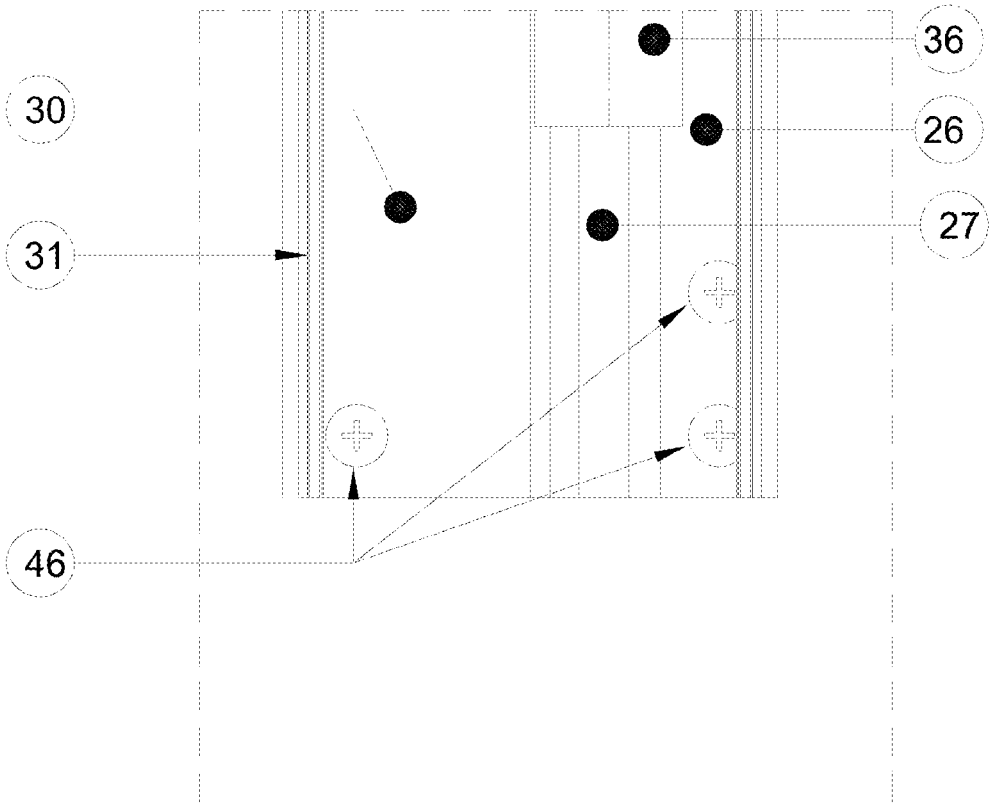

FIG. 5 is directed to the operator system located at the second side frame part 2, more particularly the side without the actuator or shifter 25, wherein said FIG. 5 is divided into at least three exploded views, as shown in FIG. 5A, FIG. 5B and FIG. 5C, for a better understanding of the operator system. Similar to FIG. 4A, the operator system, as shown in FIG. 5A, comprises a travel bar 36, a crank 35 and at least an elastic member 34. The elastic member comprising at least two ends wherein at least one of those ends is mechanically coupled to the travel bar 36. The crank 35 further comprises two ends, wherein one end is mechanically coupled to the travel bar 36 and the other end is fixed the louver 1 by means of attachment mean 41, such as screw.

In one embodiment, a spring connected to the synchro bar will neutralize the weight of the slats further, reducing the operating force required which is an ADA recommendation when the system is used by persons with disabilities. The spring is coupled with a window opening assisting mechanism having an angular displacement that shifts the linear force exerted by the spring on the operating bar or travel bar. When the window is fully closed, the spring's tension aids in keeping the slats sealed and serves as a security feature. When the slats are open, the assisting mechanism shifts the force exerted by the spring's tension and serves to equalize the weight of the slats so as to ensure that they are not forcefully closed by an external force. It will be understood that the assisting mechanism is coupled to the spring in such a way that the spring's maximal force is used to seal the slats when the window is closed. When the assisting mechanism displaces angularly, the spring adjusts its tension to equalize the weight of the slats while the assisting mechanism causes the exerting force to shift in the opposite direction, therefore keeping the windows open. In yet another embodiment, simultaneous operation manually, automatically or semi-automatically (i.e. hybrid) would allow a hybrid configuration that provides both options manually or automatically fully to be effective in unison.

Figure 6:
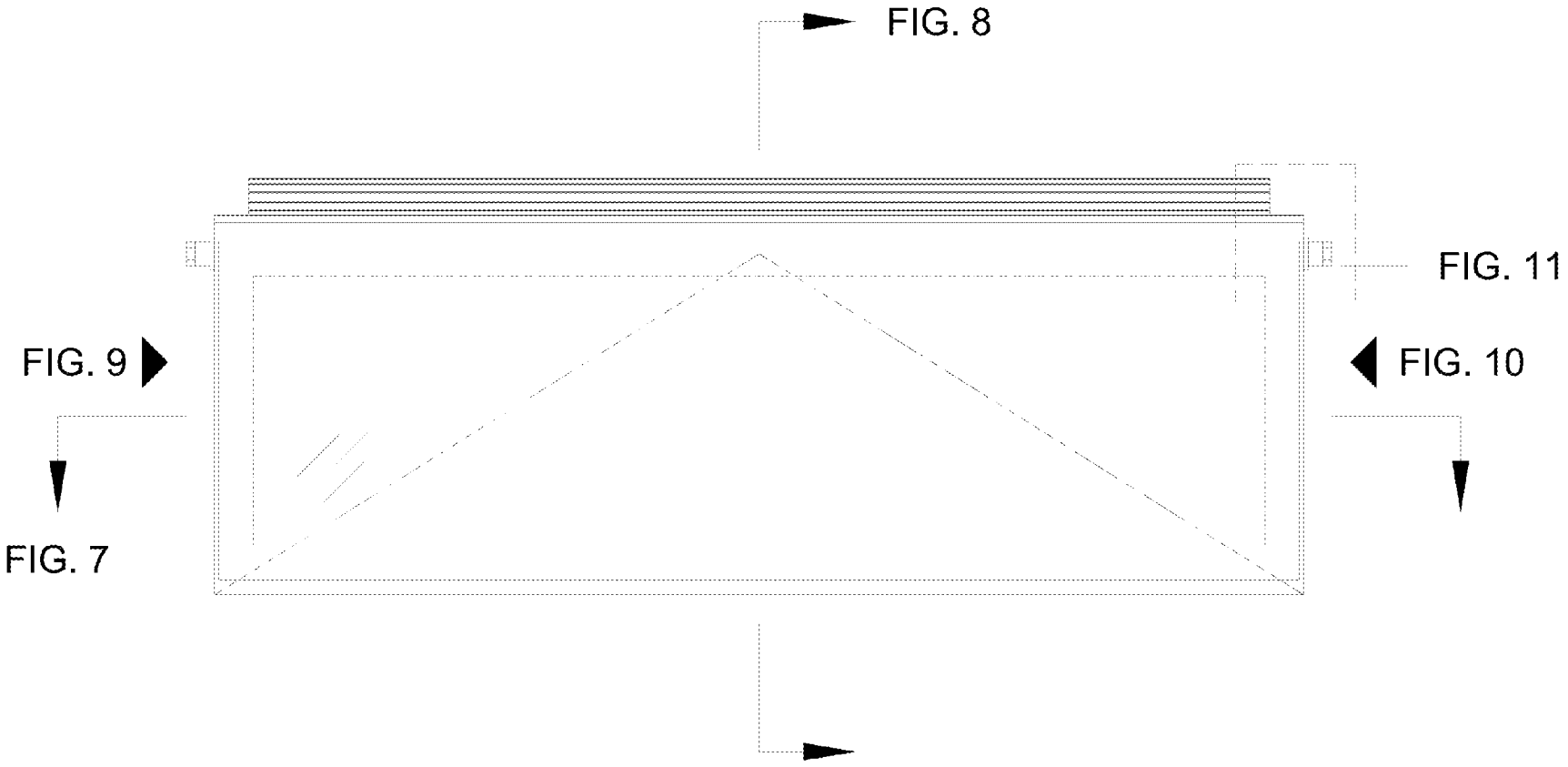
FIG. 6 is an exemplary view of the louver's structure of the first preferred embodiment in accordance with the principles of the present invention.
Figure 7:
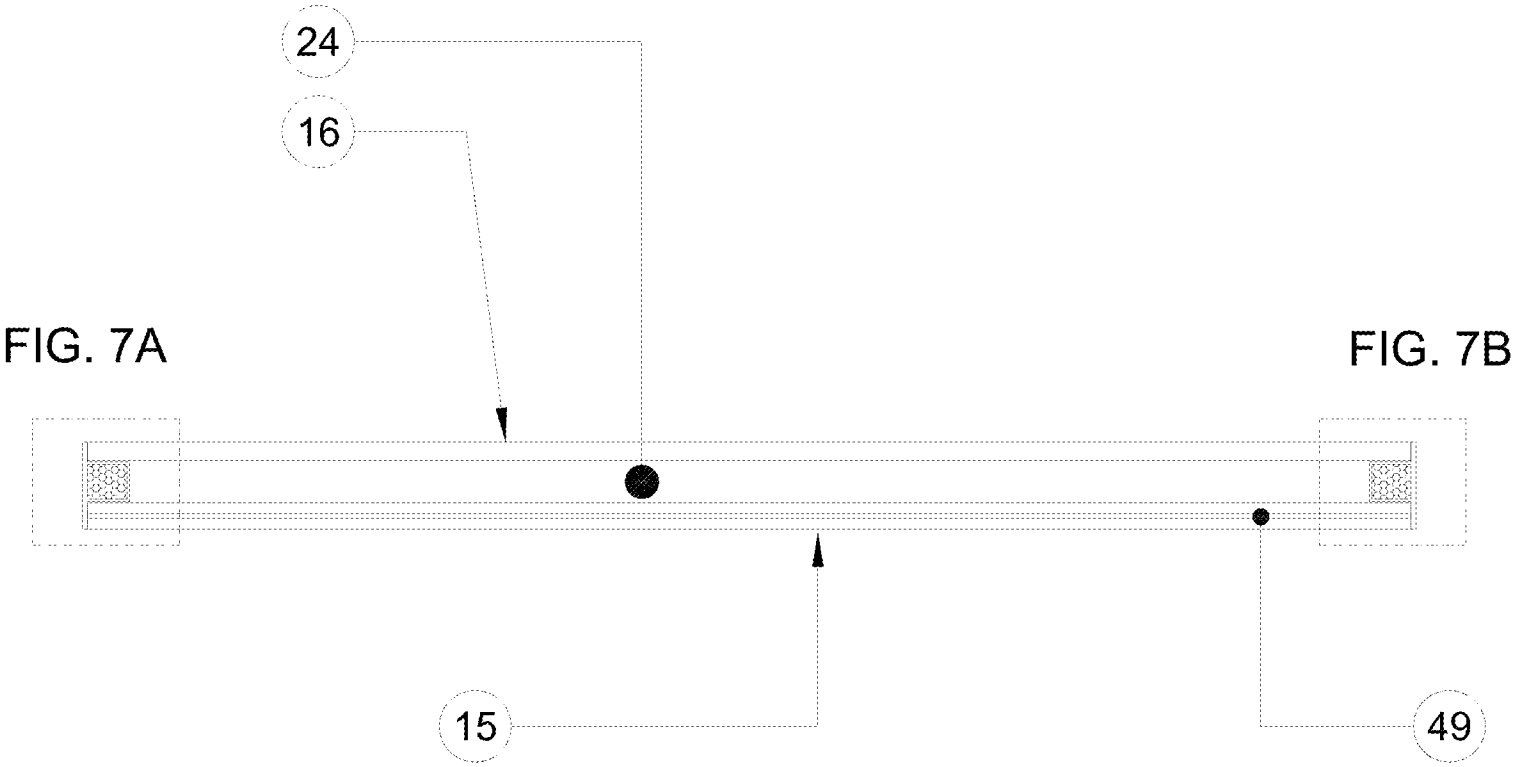
FIG. 7 is a horizontal cut-out section of FIG. 6 of the louver's structure of the first preferred embodiment in accordance with the principles of the present invention.
Figures 7A, 7B:
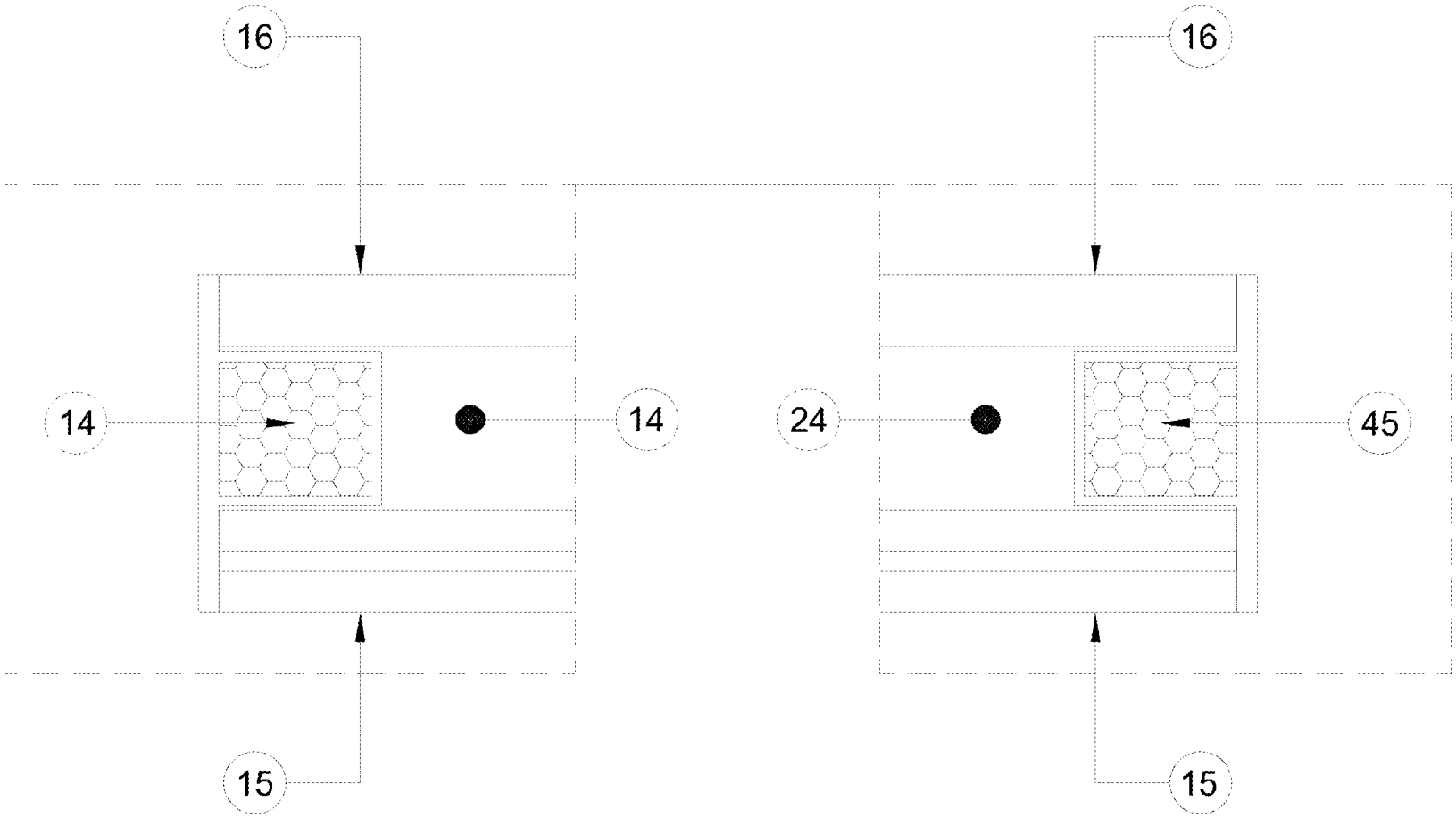
FIG. 7A-7B are exemplary exploded view of the cut-out section of FIG. 6 of the louver's structure of the first preferred embodiment in accordance with the principles of the present invention.

FIG. 6 through FIG. 11 are directed to the louver assembly. FIG. 6 is directed to an exemplary view of the structure of the first preferred embodiment for the louver 1 in accordance with the principles of the present invention. The louver 1 comprises a main frame, louver attachment elements 57, a first face glass 15, a middle section 24, and a second face glass 16. The main frame is made of a monolithic structure comprising a top louver frame part 13, bottom louver frame part 22, first side louver frame part 32 and a second side louver frame part 45. Further an impact absorbing structure is integrally made with the main frame. The impact absorbing structure, such as a honeycomb structure 14, extends towards the inner body of the louver 1. As shown in FIG. 7 the main frame supports the first face 15, an inner layer 49, a middle section 24 and second face 16. As clearly shown in FIG. 7A and FIG. 7B, the first face 15 and second face surrounds the honeycomb 14, while the middle section 24 is delimited by the honeycomb 14 structure.

Figure 8:
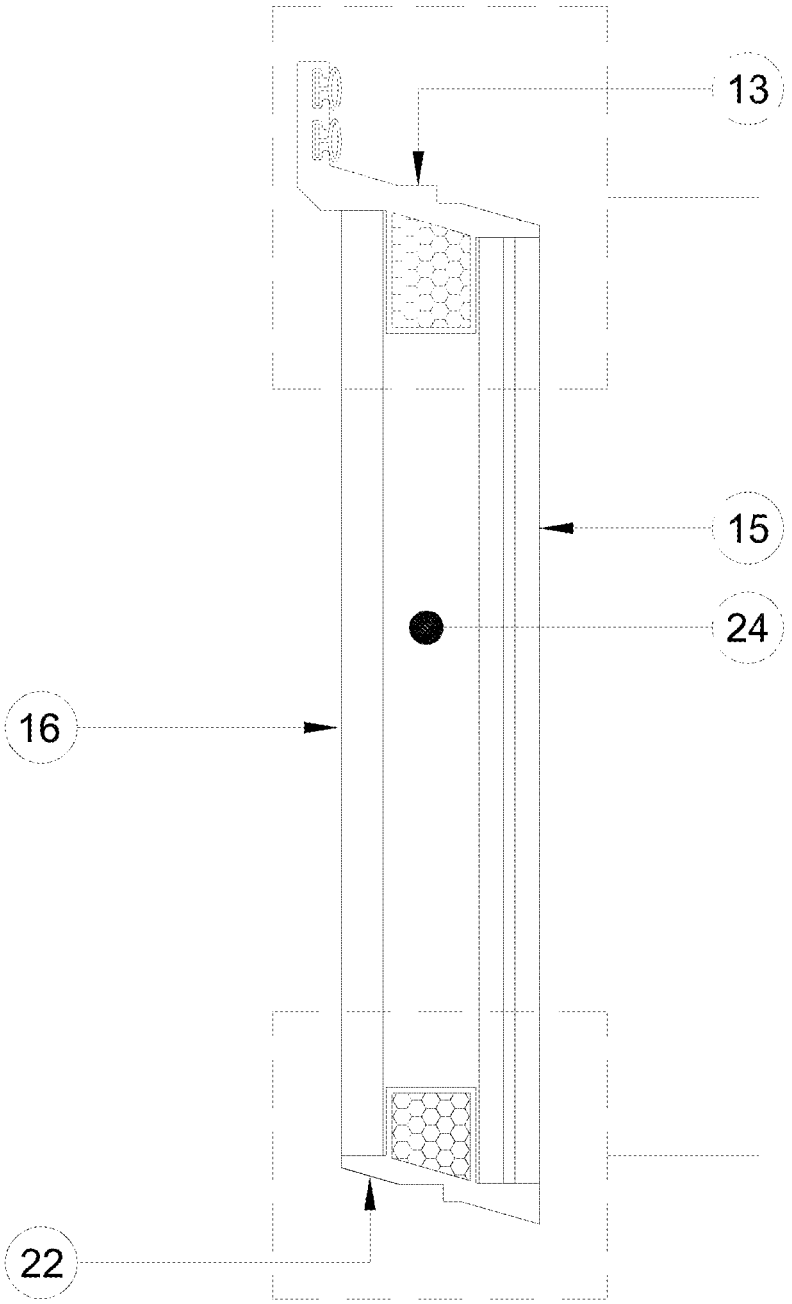
FIG. 8 is a vertical cut-out section of FIG. 6 of the louver's structure of the first preferred embodiment in accordance with the principles of the present invention.
Figure 8A:
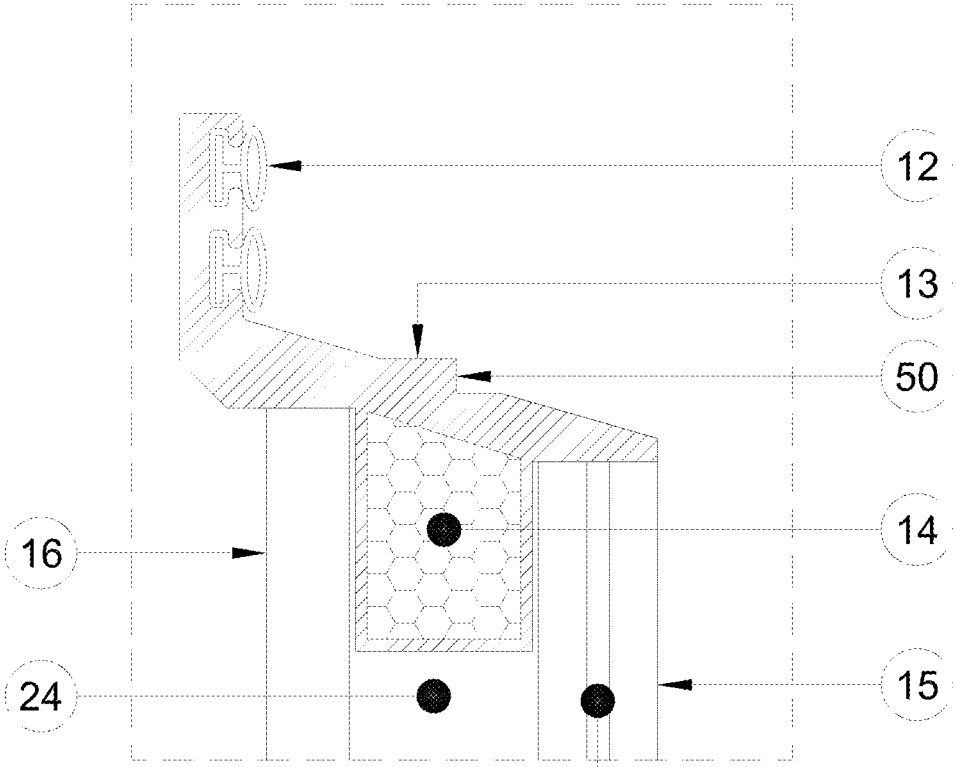
FIG. 8A-8B are exemplary exploded view of the cut-out section of FIG. 6 of the louver's structure of the first preferred embodiment in accordance with the principles of the present invention.
Figure 8B:
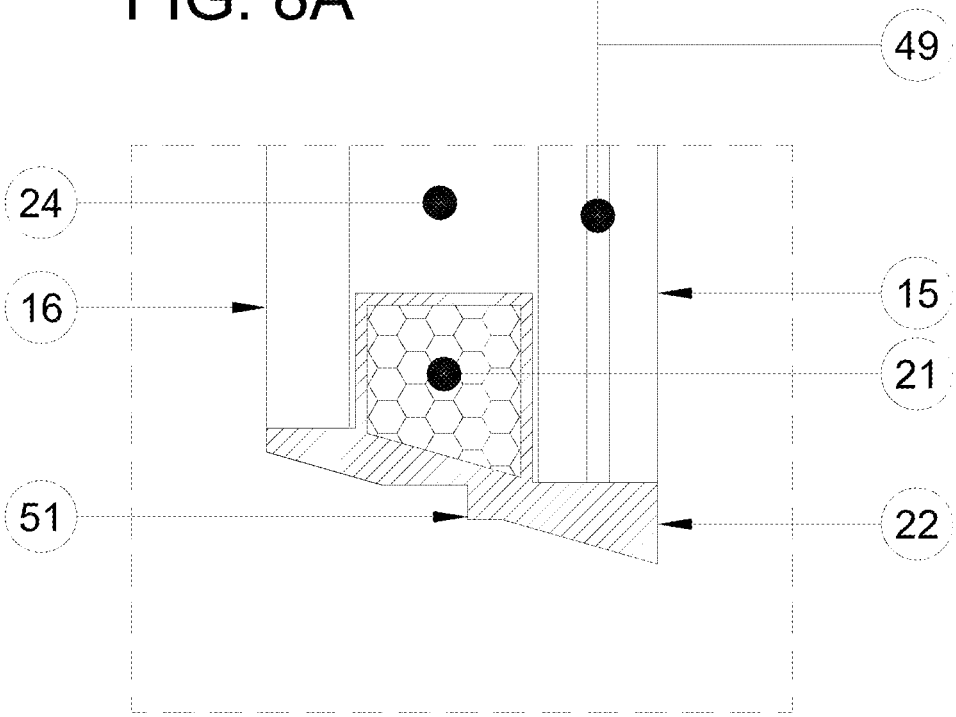

As shown in FIG. 8, the main frame comprises a top frame 13 and a bottom frame 22. FIG. 8A discloses the top frame 13, which as explained above, comprises the sealer 12. The first face comprises an inner resistance layer 49 preferably made of a translucent and/or transparent resistance material to withstand several projectiles that hit the first face 15. Thus, the thermal honey comb brake 14 as shown in FIGS. 8A and 8B, similar to the main fame is preferably made of a material that insulates thermal conductivity and sound convection between the outside and inside of the window louver. This new thermal honeycomb brake 14 allows a solid platform which increases thermal resistance, energy efficiency, climate attributes and sound attenuation.

Figures 9, 10:
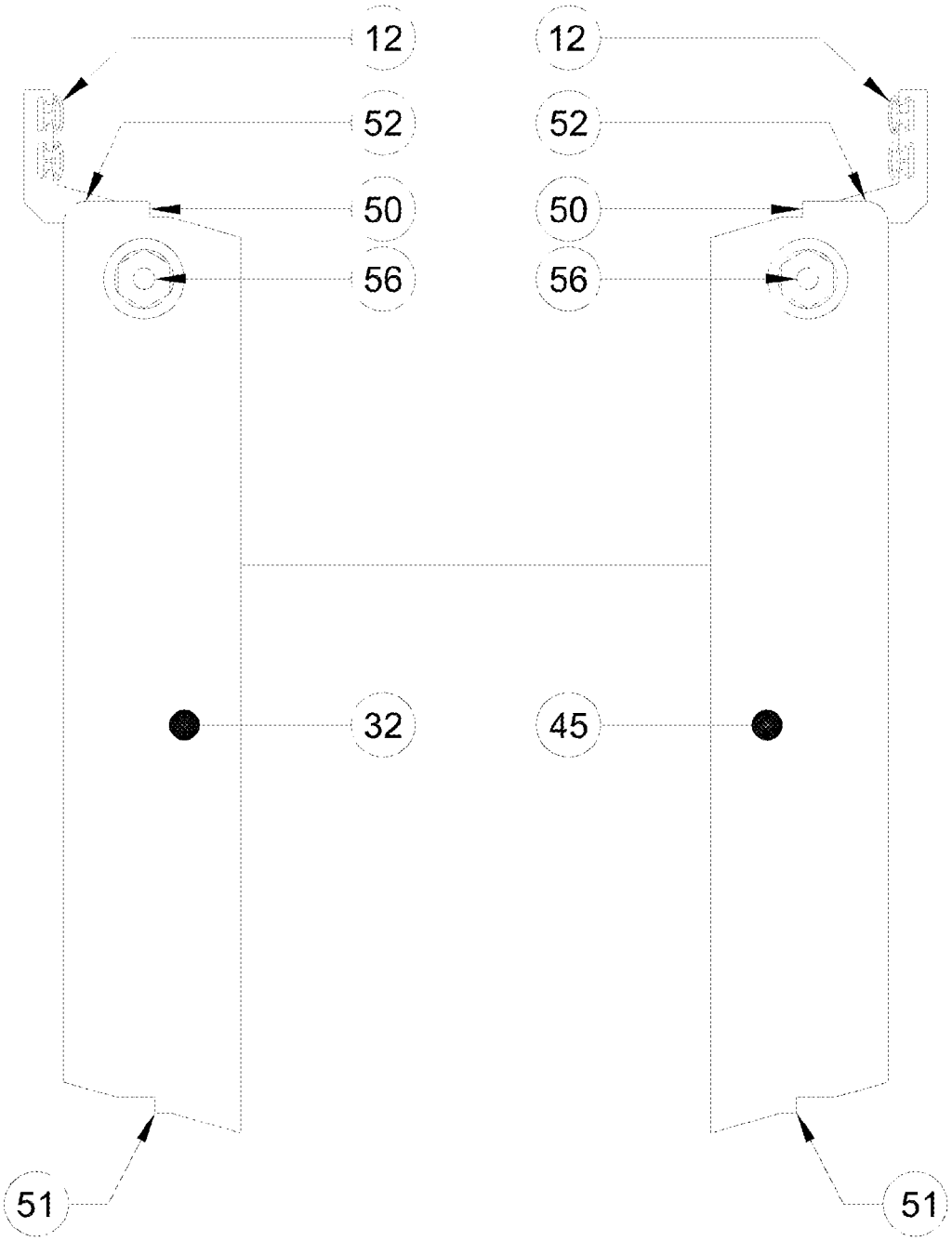
FIG. 9 is an exemplary left side view of the louver's structure of the first preferred embodiment in accordance with the principles of the present invention.
FIG. 10 is an exemplary right side view of the louver's structure of the first preferred embodiment in accordance with the principles of the present invention.
Figure 11:
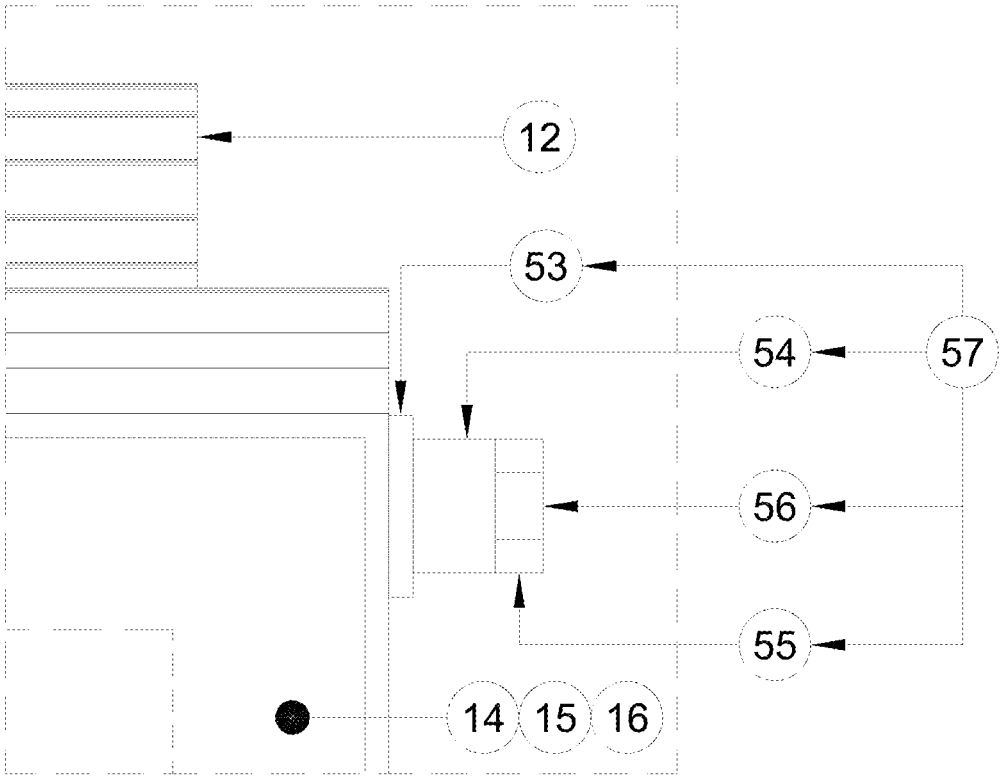
FIG. 11 is an exemplary exploded view of the louver's attachment of the first preferred embodiment in accordance with the principles of the present invention.

FIGS. 9 and 10 are directed to the main frame sides 32, 45. Each main frame side 32, 45 comprises at least a louver attachment means 57, which is coupled to the crank 35, wherein said louver attachment means 57 extends from said frame sides 32, 45. FIG. 11 explodes the louver attachment mean 57, wherein said attachment means comprises a bushing 53 (which is part of the main frame), bearing section 54, reshaped end 55 and attachment receiving element 56. The reshaped end 55 is coupled to the crank 35. The reshaped end 55 is configured to comprise a shape that avoids or assists to limit the rotational movement between the crank's end and the louver attachment mean 57. As mentioned, while one end is fixed to the louver attachment 57 the other end of said crank 35 is mechanically coupled to the travel bar 36.

Figure 12:
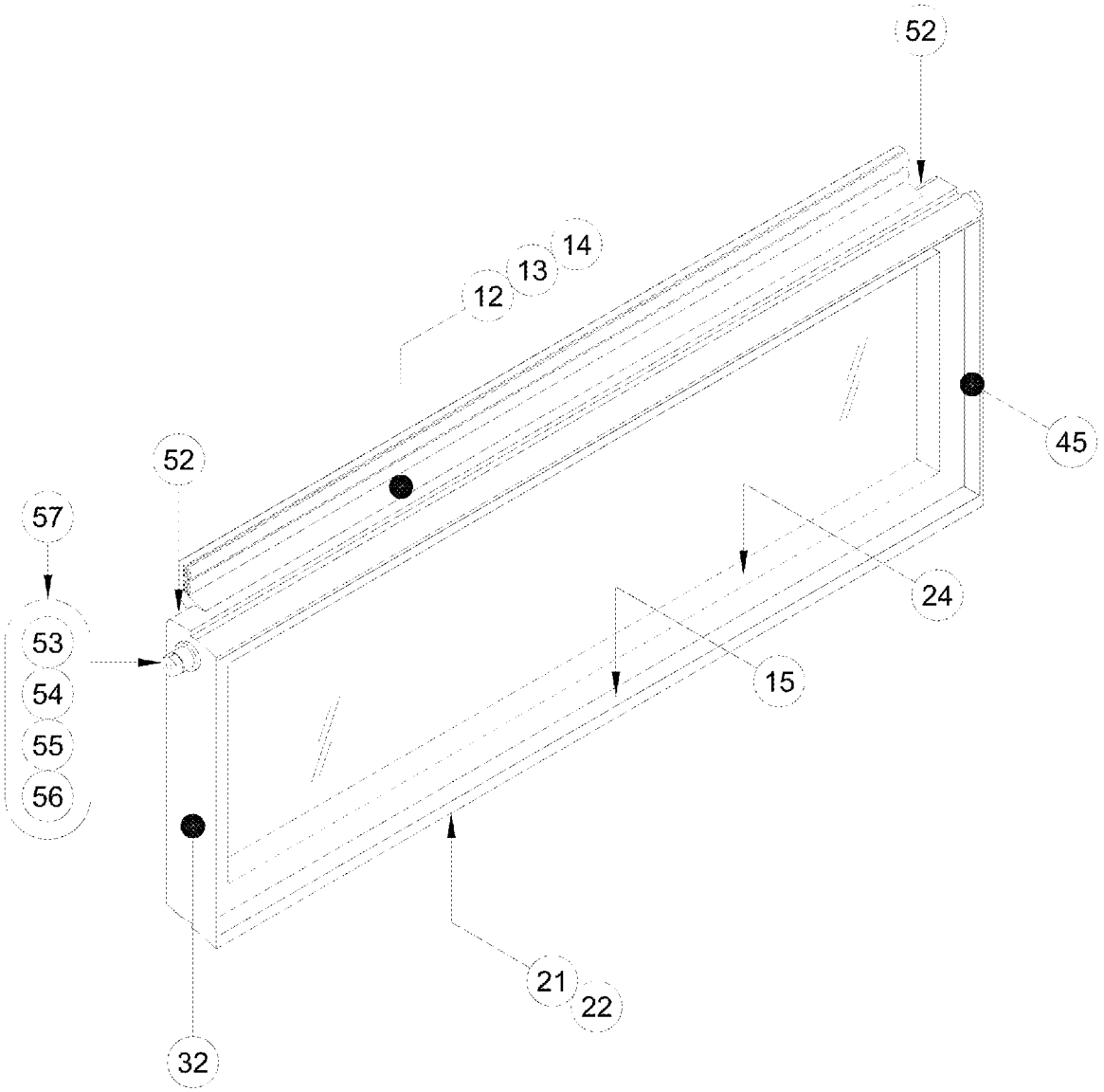
FIG. 12 is an exemplary isometric view of the louver's structure of the first preferred embodiment in accordance with the principles of the present invention.

FIG. 12 is directed to a perspective view of the louver 1. Clearly is shown the sealer 12 extended on top of the louver as part of the top louver frame 13. The frame surrounds the first face 15 and second face 16 and the honey comb is extended inside providing or generating the area for the middle section 24.

In one embodiment, the simple monobloc rolled glass louver design allows (as seen in FIGS. 6-12) avoiding the traditional need to install laminated glass within a separate non-glass framework that contains it. Said framework creates a problem in energy efficiency, acting as a thermal brake. The thickness of laminated glass is thin in individual layers, making it particularly vulnerable to failure at the edges through breakage or pitting, and increasing the glass thickness compromises the overall weight and increases cost.

Additional features may include such add-on as Wireless Smart windows (including interface to Apps), alarms, security cameras, daylight control (using electro chromatic glass). Sound may be reduced through auto reactive acoustic properties, in order to detect undesirable sonic levels (as a default), closing windows blocking the sound depending on physical location (say urban and/or near schools locations), climate control (e.g. rain, wind, etc.), dynamic ventilation control (where windows open and close independently maximizing ventilation and regulating dwelling temperature). In one embodiment, the windows may react in case of fire, temperature and smoke management (whether automatic or under fire department control), to improve the chances of escape and survival. This would potentially improve Green building scores.

The system may be comprised of the following materials; Titanium oxide crystals (biodegradation of dirt), Electro chromatic glass (regulates transparency), Shielded glassware (to provide bullet or terrorism protection). In another embodiment, the louver glass may have a translucent photovoltaic skin.

The above systems illustrates integrated operator Shifter (be it manual, assisted manual/automatic clutch system), process thermodynamics and shutters, monobloc laminated glass manufacturing process of high impact resistance louvers), Thermal break honey comb (having thermal applications to either conduction or convection) through either structural or sonic barriers; solid rock fire escape egress Windows (resistant to vandalism, impact, explosion, sound, theft and winds.

The system also is envisioned to have windows with auto reactive acoustic properties capable of detecting undesirable sonic levels as a default and reacting by closing windows blocking the sound depending on your location. In addition, in case of fire, smoke or temperature management which would improve the chances of escape and survival.

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions. It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement. And combination of parts may be resorted without departing from the spirit and scope of the invention as claimed. Accordingly, the scope of the present invention is defined by the appended claims rather than the forgoing description of embodiments.

What is claimed is:

1. A louver operational system comprising:

a housing including a top part, a first side part, a second side part and a bottom part;

an operator system comprising:

at least one actuator, at least one crank comprising a first end and a second end, at least one travel bar, at least one elastic member, at least one transmitter bar, at least one louver comprising a main frame including at least a first attachment element wherein said at least one louver extends between said first side part and said second side part, wherein said second side part comprises an outer frame including an outer hole including an outer hole surface, an inner frame, a heat barrier and said at least one elastic member comprising a proximal end and a distal end, wherein said proximal end is coupled to the travel bar and the distal end coupled to the louver via the first attachment element;

wherein said at least one actuator is mechanically coupled to the at least one transmitter bar;

wherein said at least one transmitter bar is mechanically coupled to the at least one travel bar;

wherein said first end of the crank is attached to the first attachment element, wherein said second end of the crank is mechanically coupled to the at least one travel bar;

wherein said elastic member is coupled to the travel bar and the crank to bias the louver towards a closed and sealed position and to counteract the weight of the louver in an open position, and wherein said first attachment element is in contact with the outer hole surface, holding the at least one louver on a vertical position with respect to the bottom part;

wherein the main frame of the louver comprises:

a top louver frame part including a first seal interlocking configuration, a bottom louver frame part including a second seal interlocking configuration, wherein said first seal interlocking configuration corresponds to said second seal interlocking configuration, a first side louver frame part comprising the first attachment element, wherein said first attachment element extends away from the first side louver frame part, a second side louver frame part comprising a second attachment element, wherein said second attachment element extends away from the second side louver frame part, an impact absorbing structure integrally connected to and disposed within the main frame, wherein said impact absorbing structure comprises a gas and a honeycomb structure, wherein said impact absorbing structure extends inside the main frame;

a first louver face structure comprising an inner layer;

a second louver face structure;

wherein said first louver face structure is surrounded by the main frame;

wherein said second louver face structure is surrounded by the main frame; and wherein said impact absorbing structure is located between said first louver face structure and said second louver face structure.

2. The louver operational system as in claim 1, wherein the first attachment element comprises a bushing, a bearing section, a first end and an attachment receiving element.

3. The louver operational system 1 as in claim 1, wherein said impact absorbing structure is made of a polycarbonate material.

4. The louver operational system 1 as in claim 1, wherein said main frame is made of a polycarbonate material.

5. The louver operational system 1 as in claim 1, wherein said impact absorbing structure and the main frame are integrally made of the same material.

6. The louver operational system 1 as in claim 1, wherein the second attachment element comprises a bushing, a bearing section, a first end and an attachment receiving element.

7. The louver operational system 1 as in claim 1, wherein said impact absorbing structure is attached to said top frame part.

8. The louver operational system 1 as in claim 1, wherein said impact absorbing structure is attached to said top frame part, said bottom frame part, said first side frame part and said second side frame part.

9. The louver operational system 1 as in claim 1, wherein said top frame part comprises at least a sealing element.

10. The louver operational system 1 as in claim 1, wherein said bottom frame part comprises at least a sealing element.

11. The louver operational system 1 as in claim 1, wherein said main frame is an integrally formed structure.

* * * * *